US012790790B2

(12) United States Patent
Tokieda

(10) Patent No.: US 12,790,790 B2
(45) Date of Patent: Nov. 10, 2026

(54) REMOTE OPERATION SYSTEM, REMOTE CONTROL DEVICE, AND REMOTE CONTROL METHOD

(71) Applicant: Kubota Corporation, Osaka (JP)

(72) Inventor: Yoshiki Tokieda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 65 days.

(21) Appl. No.: 18/921,197

(22) Filed: Oct. 21, 2024

(65) Prior Publication Data

US 2025/0146255 A1 May 8, 2025

(30) Foreign Application Priority Data

Nov. 2, 2023 (JP) ..... 2023-188185

(51) Int. Cl.
*E02F 9/20* (2006.01)
*E02F 3/32* (2006.01)

(52) U.S. Cl.
CPC ..... *E02F 9/205* (2013.01); *E02F 9/2004* (2013.01); *E02F 9/2033* (2013.01); *E02F 3/32* (2013.01)

(58) Field of Classification Search
CPC ..... E02F 9/205; E02F 9/2004; E02F 9/2033; E02F 3/32; E02F 3/435
See application file for complete search history.

(56) References Cited

U.S. PATENT DOCUMENTS

| | | | | |
|---|---|---|---|---|
| 10,013,017 | B2 * | 7/2018 | Bernardy | A63F 13/24 |
| 2022/0042279 | A1 * | 2/2022 | Takahashi | E02F 9/2228 |
| 2022/0170242 | A1 * | 6/2022 | Maley | G06T 7/70 |
| 2022/0275604 | A1 * | 9/2022 | Igarashi | E02F 9/205 |
| 2023/0259154 | A1 * | 8/2023 | Casartelli | B62D 55/06 37/197 |

FOREIGN PATENT DOCUMENTS

| | | | | |
|---|---|---|---|---|
| JP | H0960033 | A | 3/1997 | |
| WO | WO-2019116486 | A1 * | 6/2019 | G05G 9/047 |

OTHER PUBLICATIONS

WO2019116486 english translation (Year: 2019).*

* cited by examiner

*Primary Examiner* — Anne Marie Antonucci
*Assistant Examiner* — Nicholas Patrick Langhorne
(74) *Attorney, Agent, or Firm* — Keating & Bennett, LLP

(57) ABSTRACT

A remote operation system includes an operation lever that is movable in a movement range from a neutral position to a maximum operation position by an operator's operation input, and a remote controller configured or programmed to generate, based on a position of the operation lever, a control command to perform a work motion and wirelessly transmit the control command to a work machine. The remote controller includes a processor configured or programmed to execute a setting process to set a neutral range to limit the work motion of the work machine on a neutral position side within the movement range. The setting process includes acquiring delay information indicating a communication delay with the work machine, and adjusting a size of the neutral range based on the delay information.

16 Claims, 18 Drawing Sheets

REMOTE OPERATION SYSTEM, REMOTE CONTROL DEVICE, AND REMOTE CONTROL METHOD

CROSS REFERENCE TO RELATED APPLICATIONS

This application claims the benefit of priority to Japanese Patent Application No. 2023-188185 filed on Nov. 2, 2023. The entire contents of this application are hereby incorporated herein by reference.

BACKGROUND OF THE INVENTION

1. Field of the Invention

The present disclosure relates to remote operation systems, remote controllers, remote control methods, and computer readable media including computer programs.

2. Description of Related Art

Japanese Laid-Open Patent Publication No. 9-60033 discloses a technique for remotely operating a backhoe by operating a wired-connected operation box.

SUMMARY OF THE INVENTION

With the development of wireless communication technology in recent years, there has been consideration of connecting terminal devices such as computers or tablets with work machines such as backhoes via wireless communication for remote operation.

For example, a wireless local-area network (LAN) or a mobile communication system can be used for wireless communication between a terminal device and a work machine.

When the terminal device and the work machine are connected via wireless communication, communication delays may occur therebetween, resulting in a time difference between an operation input of an operator who operates the terminal device and a work motion of the work machine corresponding to the operation input.

For this reason, when the operator inputs an operation, the work machine performs a motion with a delay to the operator's operation input, creating the possibility that the work machine may not be operated with high accuracy. For example, the position of the work machine may exceed the target position.

According to an example embodiment of the present disclosure, a remote operation system for a work machine that performs work motions includes an operation lever that is movable in a movement range from a neutral position to a maximum operation position by an operation input of an operator, and a remote controller configured or programmed to generate, based on a position of the operation lever, a control command to perform the work motion and wirelessly transmit the control command to the work machine, wherein the remote controller includes a processor configured or programmed to execute a setting process to set a neutral range on a side of the neutral position within the movement range to limit the work motion of the work machine, and the setting process includes acquiring delay information indicating a communication delay with the work machine, and adjusting a size of the neutral range based on the delay information.

According to example embodiments of the present disclosure, it is possible to provide remote operation systems each capable of preventing a deterioration in operation accuracy.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
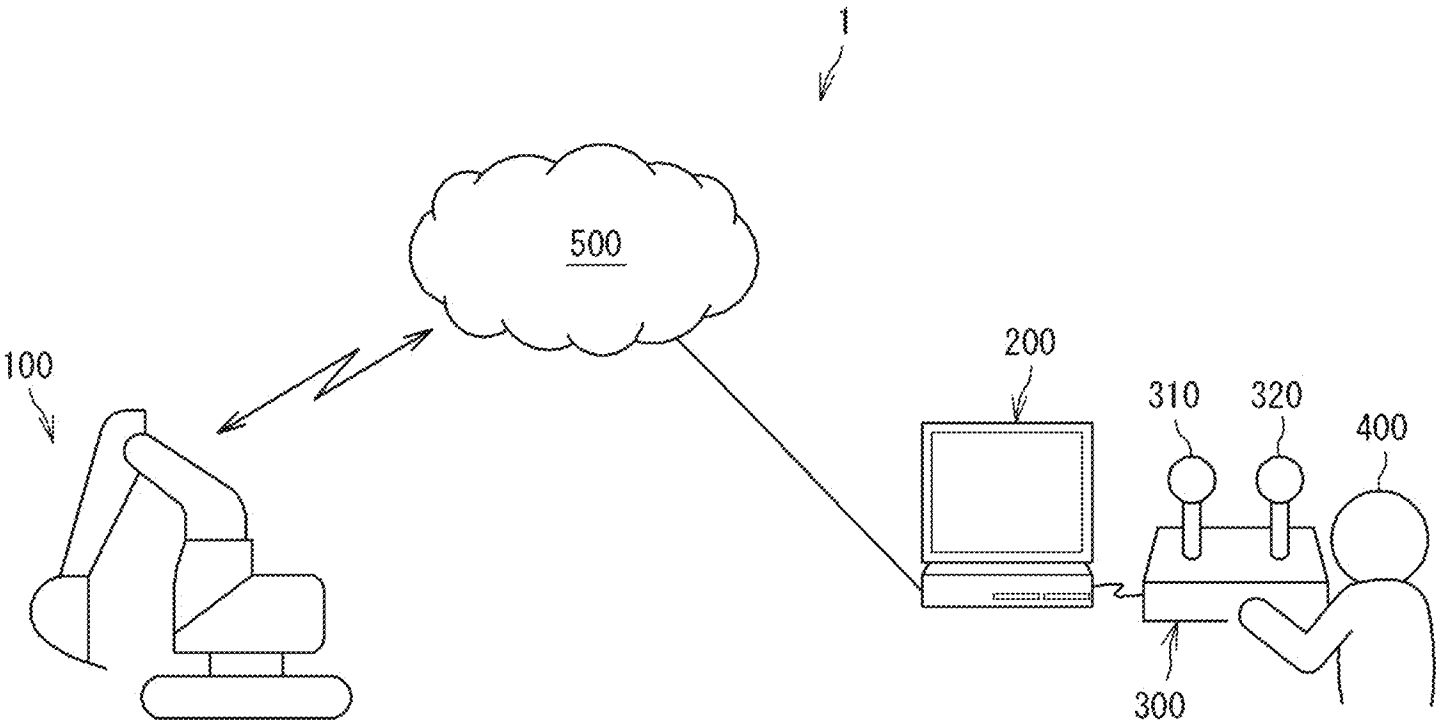
FIG. 1 is a diagram illustrating an example of an overall configuration of a remote operation system according to an example embodiment of the present invention.

First, the contents of the example embodiments will be listed and described.

(1) The present disclosure relates to a remote operation system for a work machine that performs work motions. The remote operation system includes an operation lever that is movable in a movement range from a neutral position to a maximum operation position by an operation input of an operator, and a remote controller configured or programmed to generate, based on a position of the operation lever, a control command to perform the work motion and wirelessly transmit the control command to the work machine. The remote controller includes a processor configured or programmed to execute a setting process to set a neutral range on the neutral position side within the movement range to limit the work motion of the work machine. The setting process includes acquiring delay information indicating a communication delay with the work machine, and adjusting a size of the neutral range based on the delay information.

According to the above configuration, when the neutral range is adjusted to be extended, the difference between the timing at which the operator starts operating the operation lever and the timing at which the transmission of the control command to the work machine is started becomes greater than that before the extension of the neutral range. This causes the amount of operation accepted as the control command for the work machine to be smaller than the amount of operation of the operation lever by the operator. Thus, the amount of motion of the work machine can be reduced compared to the amount of motion of the work machine before the extension of the neutral range.

Therefore, in the setting process, when the communication delay between the remote controller and the work machine becomes relatively long, the neutral range may be adjusted to be extended.

In this case, even in a situation where the communication delay has become relatively long and the work machine performs a motion with a delay to the operator's operation input, the actual amount of motion of the work machine can be reduced relative to the amount of operation by the operator. As a result, it is possible to prevent the position of the work machine from exceeding the target position, and to prevent a deterioration in operation accuracy.

Further, it is possible to make the operator aware of the situation of the long communication delay through the reduced amount of motion of the work machine relative to his or her operation, and to alert the operator.

(2) In the remote operation system of (1) above, when the delay information includes a communication delay time, the neutral range may be extended as the communication delay time increases.

In this case, as described above, even when the communication delay between the remote controller and the work machine becomes relatively long, it is possible to prevent a deterioration in operation accuracy.

(3) In the remote operation system of (1) above, when the delay information includes a communication delay time, the adjusting the size of the neutral range may include comparing the communication delay time with a predetermined threshold, and selecting, based on a result of the comparison, the size of the neutral range from a first size and a second size larger than the first size.

In this case, if the second size is selected as the size of the neutral range when the communication delay time is greater than the predetermined threshold, it is possible to prevent a deterioration in operation accuracy.

(4) In the remote operation system according to any one of (1) to (3) above, when the work motion includes a first motion and a second motion different from the first motion, the operation lever is movable in a first direction from the neutral position and is movable in a second direction orthogonal to the first direction, the control command includes a first control command to cause the work machine to perform the first motion and a second control command to cause the work machine to perform the second motion, the first control command is a command generated based on a position of the operation lever in a first movement range along the first direction from the neutral position, the second control command is a command generated based on the position of the operation lever in a second movement t range along the second direction from the neutral position, the neutral range includes a first neutral range set to the first movement range and a second neutral range set to the second movement range, a size of the first neutral range and a size of the second neutral range may be adjusted to be different from each other.

The greater the motion of the work machine, the greater the impact of the motion of the work machine on the surroundings.

Therefore, for example, when the motion of the work machine is greater during the first motion than during the second motion, by setting the first neutral range wider than the second neutral range, the actual amount of motion of the work machine relative to the amount of operation can be further reduced for the first motion, which is a greater motion. Therefore, the impact of the motion of the work machine on the surroundings can be reduced.

(5) In the remote operation system of (1) above, when the position of the operation lever is in the neutral range, the processor may be configured or programmed to execute at least one of stopping transmission of the control command by the remote controller or including a command to stop the work motion in the control command.

In this case, in any process, the work motion of the work machine can be stopped.

(6) In the remote operation system of (1) or (5) above, the setting process may further include setting a motion limit range that limits the work motion of the work machine on a side of the maximum operation position within the movement range, and adjusting a size of the motion limit range based on the delay information.

In this case, when the motion limit range is adjusted to be extended, even if the operation lever is operated significantly toward the maximum operation position, the work motion of the work machine is limited within the motion limit range. This causes the amount of operation accepted as the control command for the work machine to be smaller than the amount of operation of the operation lever by the operator.

Thus, the amount of motion of the work machine can be reduced compared to the amount of motion of the work machine before the extension of the motion limit ranged.

Therefore, when the communication delay between the remote controller and the work machine becomes relatively long, the motion limit range may be adjusted to be extended.

In this case, even in a situation where the communication delay between the remote controller and the work machine has become relatively long and the work machine performs a motion with a delay to the operator's operation input, it is possible to reduce the actual amount of motion of the work machine relative to the amount of operation by the operator by providing the motion limit range. As a result, it is possible to prevent the position of the work machine from exceeding the target position, and to prevent a deterioration in operation accuracy.

(7) In the remote operation system of (6) above, when the work motion includes a first motion and a second motion different from the first motion, the operation lever is movable in a first direction from the neutral position and is movable in a second direction orthogonal to the first direction, the control command includes a first control command to cause the work machine to perform the first motion and a second control command to cause the work machine to perform the second motion, the first control command is a command generated based on a position of the operation lever in a first movement range along the first direction from the neutral position, the second control command is a command generated based on the position of the operation lever in a second movement range along the second direction from the neutral position, the motion limit range includes a first motion limit range set in the first movement range and a second motion limit range set in the second movement range, a size of the first motion limit range and a size of the second motion limit range may be adjusted to be different from each other.

For example, when the motion of the work machine is greater during the first motion than during the second motion, by setting the first motion limit range larger than the second motion limit range, the actual amount of motion of the work machine relative to the amount of operation can be further reduced for the first motion, which is a greater motion. Therefore, the impact of the motion of the work machine on the surroundings of the work machine can be reduced.

(8) In the remote operation system of (6) or (7) above, the processor is configured or programmed to execute a process of accepting detection information from an obstacle detector included in the work machine, and the size of the motion limit range is adjusted based on the delay information and the detection information.

When the detection information includes information indicating the presence of an obstacle within the work motion range of the work machine, extending the motion limit range can reduce the actual amount of motion of the work machine relative to the amount of operation by the operator, and the work motion can be limited, for example, by stopping the work motion or by keeping the motion speed low.

(9) In the remote operation system of (8) above, when the detection information includes a distance between the work machine and an obstacle, the size of the motion limit range is extended as the distance is shorter.

In this case, the closer the work machine is to the obstacle, the more the actual amount of motion of the work machine relative to the amount of operation by the operator can be limited.

(10) In the remote operation system of (8) above, the obstacle detector may include at least one of an ultrasonic sonar sensor, a light detection and ranging (LIDAR) sensor, a millimeter wave sensor, or an image analyzer including an imager.

(11) In the remote operation system of (6) to (10) above, when the processor is configured or programmed to accept an input of a workable range of the work machine, the size of the motion limit range may be adjusted based on the delay information and the workable range.

In this case, the closer the work machine is to the boundary of the workable range, the more the actual amount of motion of the work machine relative to the amount of operation by the operator can be limited, preventing operations that would cause the work machine to exceed the workable range.

(12) In the remote operation system of (6) to (11) above, when the position of the operation lever is located in the motion limit range, the processor is configured or programmed to execute at least one of stopping transmission of the control command by the remote controller, including a command to stop the work motion in the control command, or including a command to limit a motion speed of the work motion in the control command.

In this case, in any process, the work motion of the work machine can be stopped.

(13) In the remote operation system of (1) to (12) above, when the processor is configured or programmed to execute measuring a time until the operation lever moves from the neutral position and returns to the neutral position, the size of the neutral range may be adjusted based on the delay information and the time.

The time taken for the operation lever to move from the neutral position and return to the neutral position can be used to determine whether the operation input is an input that is performed during an attempt to inch the work machine.

The operator may inch the work machine by momentarily applying an operation input to the operation lever. In the present example embodiment, it is possible to determine whether the operator has provided a very short-time operation input.

When a very short-time operation input is performed, it is difficult to accurately adjust the amount of operation.

Therefore, when a very short-time operation input is provided, the size of the neutral range can be adjusted to be extended.

Thus, even when a very short-time operation input is provided, it is possible to reduce an actual amount of motion of the work machine relative to the amount of operation by the operator.

(14) In the remote operation system of (1) to (13) above, when the work machine further includes a traveling device, a machine body slewably mounted on the traveling device, a boom that is swingable about an axis provided on the machine body and extending laterally, an arm swingably provided at a distal end of the boom, and a work tool swingably provided at a distal end portion of the arm, the work motion may include at least one of slewing of the machine body, swinging of the boom, swinging of the arm, or swinging of the work tool.

(15) The present disclosure from another viewpoint provides a remote controller. This remote controller is a device configured or programmed to generate a control command to cause a work machine to perform a work motion based on a position of an operation lever movable in a movement range from a neutral position to a maximum operation position by an operation input of an operator, and wirelessly transmit the control command to the work machine. The remote controller includes a processor configured or programmed to execute a setting process to set a neutral range on a side of the neutral position within the movement range to limit the work motion of the work machine. The setting process includes acquiring delay information indicating a communication delay with the work machine, and adjusting a size of the neutral range based on the delay information.

(16) The present disclosure from another viewpoint provides a method performed in a remote controller to generate a control command to cause a work machine to perform a work motion based on a position of an operation lever movable in a movement range from a neutral position to a maximum operation position by an operation input of an operator, and wirelessly transmit the control command to the work machine, the method being a method to set a neutral range on a side of the neutral position within the movement range to limit the work motion of the work machine. The method includes acquiring a delay information indicating communication delay between the remote controller and the work machine, and adjusting a size of the neutral range based on the delay information.

The present disclosure from another viewpoint provides a non-transitory computer readable medium including a computer program to cause a computer to execute a process in a remote controller to generate a control command to cause a work machine to perform a work motion based on a position of an operation lever movable in a movement range from a neutral position to a maximum operation position by an operation input of an operator, and wirelessly transmit the control command to the work machine, to set a neutral range on a side of the neutral position within the movement range to limit the work motion of the work machine. The computer program causes the computer to execute acquiring delay information indicating a communication delay between the remote controller and the work machine, and adjusting a size of the neutral range based on the delay information.

Hereinafter, example embodiments will be described with reference to the drawings.

Note that at least a portion of each example embodiment described below may be combined in a freely selectable manner.

FIG. 1 is a diagram illustrating an example of an overall configuration of a remote operation system according to an example embodiment.

In FIG. 1, a remote operation system 1 is a system for remotely operating a work machine.

The remote operation system 1 includes a work machine 100, a remote controller 200, and an operating device 300. Although one work machine 100 is illustrated in FIG. 1, the remote operation system 1 may include a plurality of work machines.

The work machine 100 and the remote controller 200 are communicably connected to each other via a network 500. The network 500 may be a local network or a global network. Moreover, the network 500 may be configured by combining a local network and a global network.

The work machine 100 includes a wireless communication function such as a wireless LAN or a mobile communication system. The work machine 100 is connected to the network 500 via a wireless communication function.

The work machine 100 includes a function of performing a work motion at a work site. The work machine 100 is, for example, a slewing work machine (backhoe).

The work machine 100 is capable of manual operation and remote operation. In the case of manual operation, the operator is seated in the work machine 100 and directly operates the work machine 100.

In the case of remote operation, the operator 400 performs remote operation using the remote controller 200 and the operating device 300.

The remote controller 200 is a device used by an operator 400 of the work machine 100. The remote controller 200 may include, for example, a computer, a tablet terminal, a smartphone, and the like. The operating device 300 is connected to the remote controller 200. Based on an output from the operating device 300, the remote controller 200 is configured or programmed to generate a control command. The control command is a command to cause the work machine 100 to perform a work motion. The remote controller 200 is configured or programmed to provide a control command to the work machine 100. Based on the control command, the work machine 100 performs a work motion.

The operating device 300 includes a function of accepting an operation input of the operator 400 and providing an output based on the operation input to the remote controller 200. The operating device 300 includes a first operation lever 310 and a second operation lever 320. The operating device 300 accepts operation inputs of the operator 400 using the first operation lever 310 and the second operation lever 320.

Figure 2:
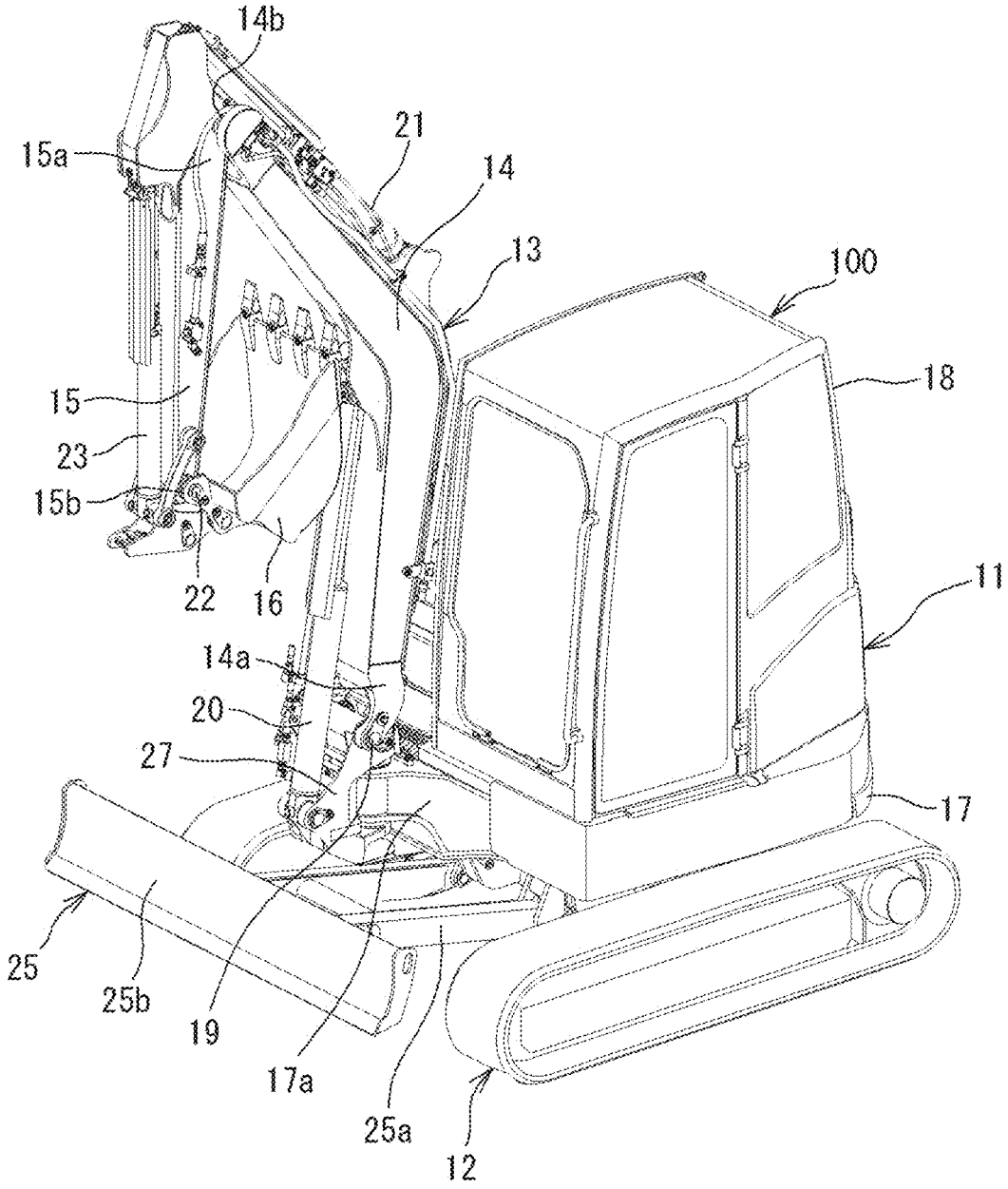
FIG. 2 is a perspective view illustrating an example of a work machine.

FIG. 2 is a perspective view illustrating an example of the work machine 100.

The work machine 100 includes a machine body (slewing table) 11, a traveling device 12, and a work device 13. The work device 13 includes a boom 14, an arm 15, a work tool 16, and a dozer device 25.

In FIG. 2, the forward direction of the traveling device 12 is defined as the forward direction, and the opposite direction is defined as the backward direction. Further, the right side of traveling device 12, when facing forward, is defined as the right direction, and the opposite side is defined as the left direction.

The traveling device 12 is a crawler type device, for example. The traveling device 12 is driven by a hydraulic actuator (not illustrated). Note that the traveling device 12 is not limited to the crawler type and may be a wheel type.

The machine body 11 is slewably mounted on the traveling device 12. The machine body 11 is slewable about a slewing axis along the vertical direction. The machine body 11 slews by hydraulic pressure or electric power.

The machine body 11 includes a slewing frame 17 and a cabin 18. The slewing frame 17 is slewably provided on the traveling device 12. The cabin 18 is provided on the slewing frame 17. A driver's seat in which an operator is seated is provided inside the cabin 18. Instead of the cabin 18, a canopy (not illustrated) may be provided, or neither the cabin 18 nor the canopy may be provided. The work machine 100 may not include a driver's seat.

Of the surfaces of the machine body 11, the surface on which the work device 13 is provided is the front surface. In the illustrated example, the front surface of the machine body 11 faces forward. The following description will be given assuming that the front surface of the machine body 11 faces forward.

The slewing frame 17 is equipped with a prime mover and a hydraulic device (not illustrated). The prime mover includes an internal combustion engine such as a diesel engine or a gasoline engine, as well as an electric motor and a hybrid prime mover that combines an internal combustion engine with an electric motor.

The hydraulic device includes a function of generating a hydraulic pressure by the driving force of the prime mover. The hydraulic pressure by the hydraulic device is applied to a hydraulic actuator, a hydraulic cylinder, and the like of each structural element.

The working device 13 is attached to a bracket 17*a* via a swing bracket 27. The bracket 17*a* protrudes from the front end of the slewing frame 17. The swing bracket 27 is attached to the bracket 17*a* so as to be pivotable (swingable) about the vertical axis. A hydraulic cylinder (not illustrated) is provided between the machine body 11 and the swing bracket 27. The swing bracket 27 is driven to pivot horizontally by extension and contraction of the hydraulic cylinder.

The swing bracket 27 swingably supports the boom 14. The boom 14 is a columnar arm extending from the swing bracket 27.

The swing bracket 27 is equipped with a support shaft 19 that supports the boom 14. The support shaft 19 is a shaft extending in the left-right direction (lateral direction). The support shaft 19 couples a base 14*a* of the boom 14 to the swing bracket 27. The boom 14 is swingable about the support shaft 19. Thus, as illustrated in the drawing, the boom 14 swings between its upright position after extending upward from the swing bracket 27 and its laid-down position after extending forward from the swing bracket 27.

A hydraulic cylinder 20 is provided between the boom 14 and the swing bracket 27. The boom 14 is driven to swing by extension and contraction of the hydraulic cylinder 20.

The arm 15 is provided at a tip 14*b* of the boom 14. The arm 15 is a columnar structure extending from the tip 14*b*.

The tip 14*b* is equipped with a support shaft (not illustrated) that supports the arm 15. The support shaft is a shaft extending in the left-right direction (lateral direction). The support shaft couples the tip 14*b* to a base 15*a* of the arm 15. The arm 15 is swingable about the support shaft. Thus, the arm 15 swings along a plane including the front-rear direction and the vertical direction about the tip 14*b*.

A hydraulic cylinder 21 is provided between the arm 15 and the boom 14. The arm 15 is driven to swing by extension and contraction of the hydraulic cylinder 21.

The work tool 16 is provided at a tip 15*b* of the arm 15. In the present example embodiment, the work tool 16 is a bucket. In addition to the bucket, the work tool 16 may include a hydraulic breaker, a hydraulic crusher, an angle bloom, an earth auger, a pallet fork, a sweeper, a mower, a snow blower, and the like.

The tip 15*b* is equipped with a support shaft 22 that supports the work tool 16. The support shaft 22 is a shaft extending in the left-right direction (lateral direction). The support shaft 22 couples the tip 15*b* to the base of the work tool 16. The work tool 16 is swingable about the support shaft 22. Thus, the work tool 16 swings along a plane including the front-rear direction and the vertical direction about the support shaft 22.

A hydraulic cylinder 23 is provided between the arm 15 and the work tool 16. The work tool 16 is driven to swing by extension and contraction of the hydraulic cylinder 23.

The dozer device 25 includes an arm portion 25*a* attached to the traveling device 12 so as to be swingable in the vertical direction, and a blade (dozing plate) 25*b* attached to a distal end of the arm portion 25*a*. A hydraulic cylinder (not illustrated) is provided between the traveling device 12 and the arm portion 25*a*. The arm portion 25*a* and the blade 25*b* are driven to swing in the vertical direction by extension and contraction of the hydraulic cylinder.

The work machine 100 can perform various work motions by controlling the hydraulic cylinder or the like of each structural element. The work motion of the work machine 100 includes, for example, lifting and lowering motions of the boom 14, dumping and scraping motions of the arm 15, dumping and scraping motions of the work tool 16, a swing motion of pivoting the work device 13 about the vertical axis relative to the machine body 11, lifting and lowering motions of the dozer device 25, and a slewing motion of the machine body (slewing table) 11.

The lifting motion of the boom 14 is a motion of swinging the boom 14 in a direction where the boom 14 is made upright. The lowering motion of the boom 14 is a motion of swinging the boom 14 in a direction where the boom 14 is laid down.

The dumping motion of the arm 15 is a motion of swinging the arm 15 in a direction away from the boom 14 and is, for example, a motion of discharging earth, sand, and the like within the work tool 16. The scraping motion of the arm 15 is a motion of swinging the arm 15 in a direction approaching the boom 14 and is, for example, a motion of scooping earth, sand, and the like using the work tool 16.

The dumping motion of the work tool 16 is a motion of swinging the work tool 16 in a direction away from the arm 15 and is, for example, a motion of discharging earth, sand, and the like within the work tool 16. The scraping motion of the work tool 16 is a motion of swinging the work tool 16 in a direction approaching the arm 15 and is, for example, a motion of scooping earth, sand, and the like using the work tool 16.

In addition, the work machine 100 includes devices required for remote operation. The devices required for remote operation include a positioning device, a camera, an obstacle sensor, a communication module, a control device, and the like.

Figure 3:
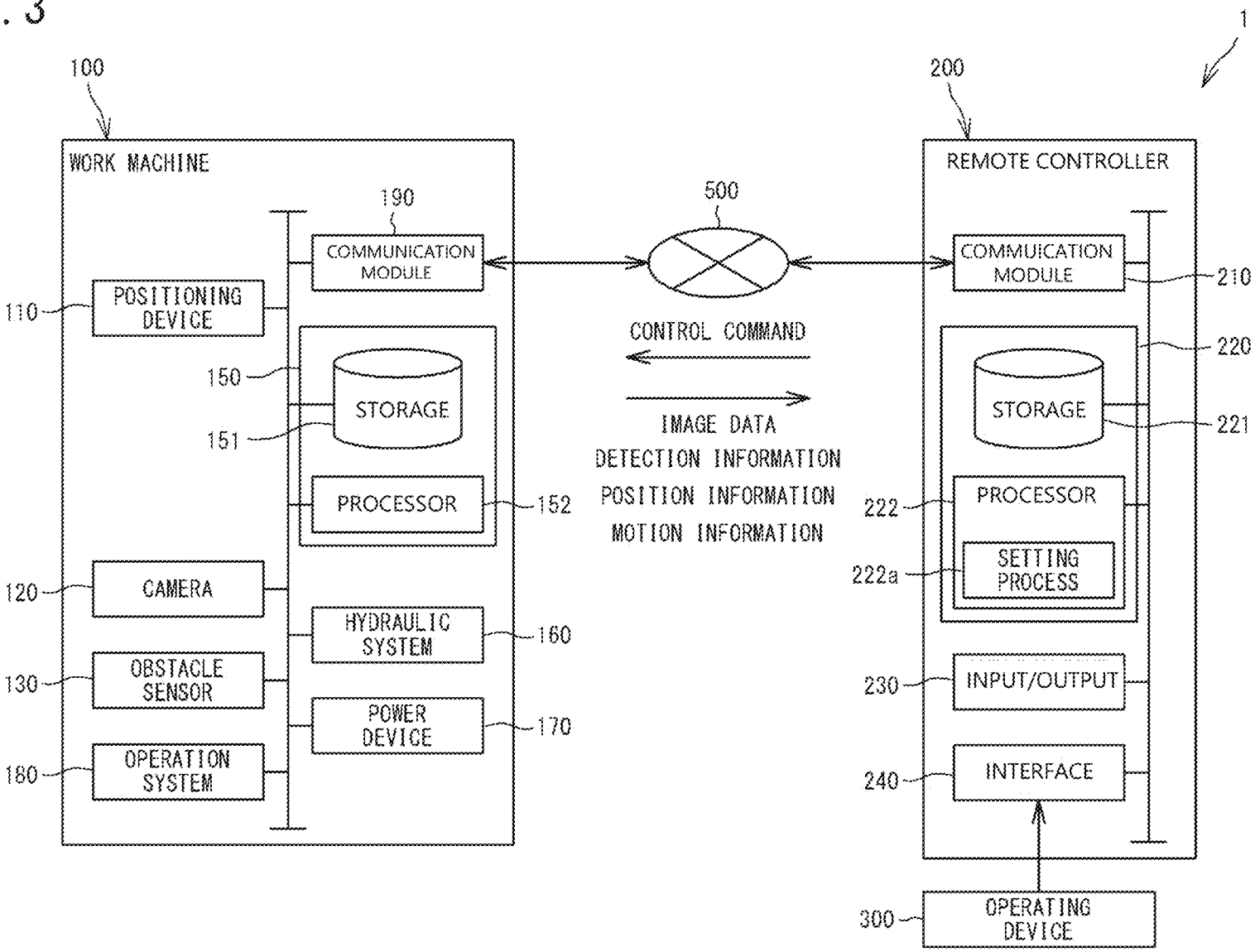
FIG. 3 is a block diagram illustrating an example of configurations of the work machine and a remote controller.

FIG. 3 is a block diagram illustrating an example of the configurations of the work machine 100 and the remote controller 200.

In FIG. 3, the work machine 100 includes a positioning device 110, a camera 120, an obstacle sensor 130, a control system 150, a hydraulic system 160, a power device 170, an operation system 180, and a communication module 190. These components are communicably connected by a bus to define an in-vehicle network.

The communication module 190 includes a function of communicating with the remote controller 200 via the network 500. The communication module 190 includes, for example, a function as a wireless LAN terminal and a function as a wireless communication terminal in a mobile communication system.

The positioning device 110 includes a global navigation satellite system (GNSS) receiver, an inertial measurement unit (IMU), and the like. The positioning device 110 receives satellite signals from a plurality of GNSS satellites using the GNSS receiver and performs positioning based on the satellite signals.

The inertial measurement unit (IMU) includes a three-axis acceleration sensor and a three-axis gyro sensor. The IMU outputs data indicating the attitude, orientation, speed, and the like of the work machine 100 using these sensors.

The positioning device 110 uses data obtained from the IMU to complement position data based on positioning using satellite signals. This enhances the accuracy of the position information obtained by the positioning device 110.

The position information obtained by the positioning device 110 is provided to the control system 150.

The camera 120 is an imager that captures an image around the work machine 100. The camera 120 includes an imaging element such as a charge-coupled device (CCD) or a complementary metal-oxide-semiconductor (CMOS). The camera 120 captures an image around the work machine 100 and generates image (video) data.

The image data generated by the camera 120 is processed by the control system 150 and then transmitted to the remote controller 200. The image data is output from a monitor or the like on the remote controller 200. The operator remotely operates the work machine 100 while viewing the image data output from the remote controller 200.

Note that the image data generated by the camera 120 may be used for positioning or obstacle detection.

The obstacle sensor 130 (obstacle detector) detects an object present around the work machine 100. The obstacle sensor 130 includes, for example, a light detection and ranging (LiDAR) sensor. In this case, the obstacle sensor 130 continuously outputs sensor data indicating a distance and a direction of each measurement point in an object present around the work machine 100, or a two-dimensional or three-dimensional coordinate value of each measurement point. The sensor data is provided to the control system 150. The control system 150 uses the sensor data to detect an obstacle around the work machine 100.

The obstacle sensor 130 may include sensors that detect the presence or absence of an obstacle using laser light, LED light, ultrasonic waves, and millimeter waves. These sensors provide outputs indicating the presence or absence of an obstacle in the detection range to the control system 150.

The hydraulic system 160 represents the entire system related to hydraulic motions in the work machine 100 and includes the hydraulic device, hydraulic actuators, and hydraulic cylinders, as well as a hydraulic circuit that distributes hydraulic pressure to each structural element.

The hydraulic circuit of the hydraulic system 160 is controlled by a motion command provided from the control system 150. That is, the lifting and lowering motions of the boom 14, the dumping and scraping motions of the arm 15, and the dumping and scraping motions of the work tool 16 in the work machine 100 are executed by motion commands from the control system 150.

The power device 170 includes a prime mover and equipment that control the prime mover. The power device 170 is controlled by a command provided from the control system 150.

The control system 150 includes a storage 151 and a processor 152.

The processor 152 may include, for example, various processors adapted to computer control, such as a central processor unit (CPU), a graphics processor unit (GPU), a digital signal processor (DSP), and a field-programmable gate array (FPGA).

The storage 151 may include, for example, a flash memory, a hard disk, a read only memory (ROM), a random access memory (RAM), or the like.

The storage 151 stores a computer program to be executed by the processor 152, along with necessary information. The processor 152 implements various processing functions of the processor 152 by executing computer programs stored in a computer-readable non-transitory recording medium, such as the storage 151.

The processor 152 is configured or programmed to perform a function of generating a motion command to be provided to the hydraulic system 160. The processor 152 is configured or programmed to provide a motion command to the hydraulic system 160, causing each structural element of the work machine 100 to perform a motion. As a result, the work machine 100 performs work motions.

The motion command is generated based on a control command provided from the remote controller 200. The control command is provided to the processor 152 (control system 150) via the network 500 and the communication module 190.

The processor 152 is configured or programmed to perform a function of generating detection information using sensor data of the obstacle sensor 130. The detection information is information indicating whether there is an obstacle around the work machine 100. When there is an obstacle, the detection information includes the distance between the obstacle and the work machine 100 and the position of the obstacle. The processor 152 provides the detection information to the remote controller 200.

Note that the processor 152 may detect an obstacle using image data and generate detection information.

The processor 152 is configured or programmed to perform a function of processing the image data generated by the camera 120 and providing the processed image data to the remote controller 200.

Further, the processor 152 is configured or programmed to perform a function of providing the position information generated by positioning device 110 to the remote controller 200.

Moreover, the processor 152 is configured or programmed to perform a function of providing motion information indicating the motion state of each structural element of the work machine 100 to the remote controller 200. The motion information is acquired based on the state of the hydraulic system 160, sensors provided in each structural element, and the like.

Various data generated by the positioning device 110, the camera 120, the obstacle sensor 130, and the like, as well as various data such as control and motion commands, are stored in the storage 151.

The operation system 180 is a system for the operator seated in the work machine 100 to operate the work machine 100. The operation system 180 includes operation equipment that is provided in the driver's seat and accepts the operator's operation, equipment that performs a necessary process to provide the accepted operation to the control system 150, and the like.

In FIG. 3, the remote controller 200 includes a communication module 210, a control system 220, an input/output 230, and an interface 240. These components are communicably connected by a bus.

The communication module 210 is configured or programmed to perform a function of communicating with the work machine 100 via the network 500. The communication module 210 is configured or programmed to, for example, function as a wireless LAN terminal and function as a wireless communication terminal in a mobile communication system.

The input/output 230 is configured or programmed to accept an input by the operator 400 and output various types of information. The input/output 230 includes, for example, input devices such as a keyboard, mouse, and touch panel, and output devices such as a monitor, speaker, and printer.

The interface 240 is configured or programmed to accept an output from the operating device 300. The operating device 300 is connected to the interface 240. The output from the operating device 300 is provided to the control system 220 via the interface 240.

The control system 220 includes a storage 221 and a processor 222.

The processor 222 may include, for example, various processors adapted to computer control, such as a central processor unit (CPU), a graphics processor unit (GPU), a digital signal processor (DSP), and a field-programmable gate array (FPGA).

The storage 221 may include, for example, a flash memory, a hard disk, a read only memory (ROM), a random access memory (RAM), or the like.

The storage 221 stores a computer program to be executed by the processor 222, along with necessary information. The processor 222 is configured or programmed to perform various processing functions of the processor 222 by executing computer programs stored in a computer-readable non-transitory recording medium, such as the storage 221.

The processor 222 outputs the image data provided from the work machine 100 to the monitor of the input/output 230 as an image (video). This enables the operator 400 to view the surroundings of the work machine 100 through the image output from the input/output 230.

The processor 222 is configured or programmed to perform a function of generating a control command. The control command is a command to cause the work machine 100 to perform a work motion as described above. Based on an output from the operating device 300, the processor 222 generates a control command.

The processor 222 is configured or programmed to perform a function of executing a setting process 222*a*. The setting process 222*a* is a process of setting a neutral range and a motion limit range for the operation range of the operation lever of the operating device 300. The setting process 222*a* will be described later.

Further, the processor 222 is configured or programmed to perform a function of performing a process of reflecting detection information provided from the work machine 100 in the setting process 222*a*.

Moreover, the processor 222 is configured or programmed to perform a function of performing a process of accepting a workable range and reflecting the workable range in the setting process 222*a*. The workable range is a range within which the work machine 100 is allowed to perform a work motion and is a preset range. The operator 400 inputs the workable range using an input device or the like of the input/output 230. The processor 222 accepts the workable range via the input/output 230.

Figure 4A:
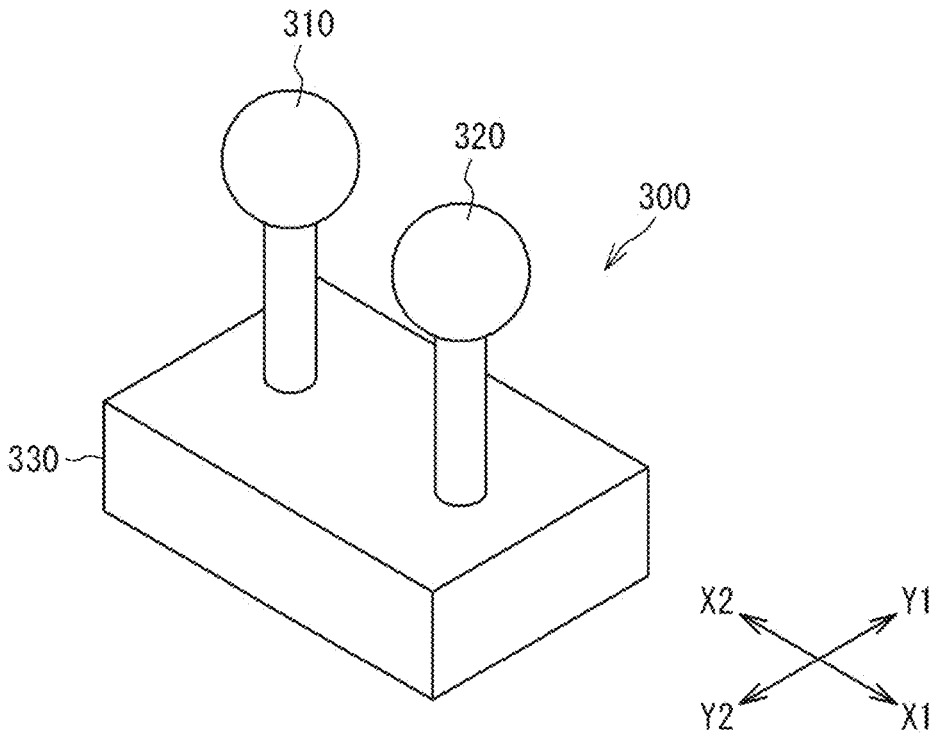
FIG. 4A is an external view of the operating device.

FIG. 4A is an external view of the operating device 300.

As illustrated in FIG. 4A, the operating device 300 includes the first operation lever 310, the second operation lever 320, and a main body 330. The first operation lever 310 and the second operation lever 320 are tiltably provided on the main body 330.

Note that the configuration of the operating device 300 is not limited to the configuration illustrated in FIG. 4A and may, for example, be a joystick type, pad controller type, arcade controller type, proportional control type, or other types. Further, the operator 400 may be allowed to select any operating device from among a plurality of types of operating devices according to his or her preference, work application, and the like. The method of selecting the operating device is not particularly limited. For example, selectable operating devices may be displayed on the remote controller 200 and the operator may select one, or the type of operating device to which the remote controller 200 is connected may be recognized automatically.

In a state where no operation input is provided, the first operation lever 310 and the second operation lever 320 are in upright positions, substantially orthogonal to the main body 330. The upright position of each of the levers 310, 320 is also referred to as a neutral position.

The first operation lever 310 and the second operation lever 320 in the neutral positions are tilted and moved by operation inputs of the operator 400. The operating device 300 provides outputs indicating the positions of the first operation lever 310 and the second operation lever 320 to the remote controller 200.

Thus, the operating device 300 accepts operation inputs of the operator 400 using the first operation lever 310 and the second operation lever 320.

In FIG. 4A, the directions orthogonal to each other on an upper surface 331 of main body 330 are defined as the X direction and the Y direction. The levers 310, 320 are arranged along the X direction. One direction of the X direction is defined as an X1 direction, and a direction opposite to the X1 direction is defined as an X2 direction. One direction of the Y direction is defined as a Y1 direction, and a direction opposite to the Y1 direction is defined as a Y2 direction.

Operation inputs (tilting operations) can be performed using the first operation lever 310 and the second operation lever 320 in 360-degree directions from the neutral positions in plan view. Work motions of the work machine 100 are assigned according to the X-direction and Y-direction components of the operation inputs (the amounts of tilting operations) to the first operation lever 310 and the second operation lever 320.

Figure 4B:
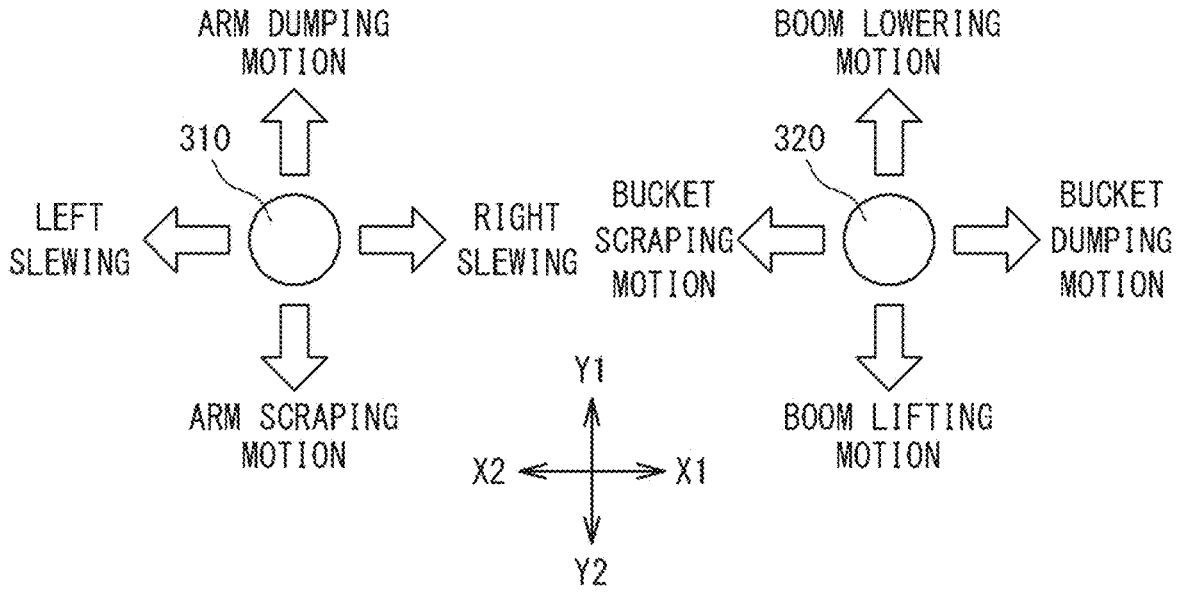
FIG. 4B is a view illustrating an example of assigning a work motion to an operation input in each direction of a first operation lever and a second operation lever.

FIG. 4B is a view illustrating an example of assigning a work motion to an operation input in each direction of the first operation lever 310 and the second operation lever 320.

The assignment of the work motion to each operation direction of the first operation lever 310 and the second operation lever 320 is not limited thereto. For example, the operator 400 may be allowed to select from a plurality of preset patterns, or the operator may be allowed to set patterns in a freely selectable manner.

In FIG. 4B, the operating device 300 is viewed in plan view. Thus, each of the levers 310, 320 is located in the neutral position.

As illustrated in FIG. 4B, among the operation inputs to the first operation lever 310, the dumping motion of the arm 15 is assigned to the operation input in the Y1 direction from the neutral position.

Among the operation inputs to the first operation lever 310, a scraping motion of the arm 15 is assigned to an operation input from the neutral position to the Y2 direction.

Among the operation inputs to the first operation lever 310, the right slewing motion of the machine body 11 is assigned to the operation input in the X1 direction from the neutral position.

Among the operation inputs to the first operation lever 310, the left slewing motion of the machine body 11 is assigned to the operation input from the neutral position to the X2 direction.

Among the operation inputs to the second operation lever 320, the lowering motion of the boom 14 is assigned to the operation input from the neutral position to the Y1 direction.

Among the operation inputs to the second operation lever 320, the lifting motion of the boom 14 is assigned to the operation input from the neutral position to the Y2 direction.

Among the operation inputs to the second operation lever 320, a dumping motion of the work tool 16 is assigned to an operation input in the X1 direction from the neutral position.

Among the operation inputs to the second operation lever 320, a scraping motion of the work tool 16 is assigned to an operation input from the neutral position in the X2 direction is assigned.

The operating device 300 provides outputs indicating the positions of the first operation lever 310 and the second operation lever 320 to the remote controller 200.

Based on the position of each of the first operation lever 310 and the second operation lever 320, the processor 222 of the remote controller 200 is configured or programmed to generate a control command.

The processor 222 is configured or programmed to generate a command value for the motion speed corresponding to the position of each of the levers 310, 320 as a control command.

The processor 152 of the work machine 100 to which the control command is provided is configured or programmed to generate a motion command corresponding to the command value for the motion speed and provide the motion command to the hydraulic system 160.

The hydraulic system 160 controls each structural element according to the motion command (the command value for the motion speed). As a result, the work machine 100 performs a work motion corresponding to the operation input of each of the levers 310, 320.

Note that the control command (motion command) is also a command to initiate the motion of each structural element in the hydraulic system 160, and the hydraulic system 160 stops the motion of each structural element when no control command is provided.

When the control command is provided, the hydraulic system 160 initiates the motion of each structural element and causes each structural element to perform a motion at a speed corresponding to the command value.

The control command is generated based on the control command provided from the remote controller 200. The control command is provided to the processor 152 (control system 150) via the network 500 and the communication module 190.

The processor 152 is configured or programmed to perform a function of generating detection information using sensor data of the obstacle sensor 130. The detection information is information indicating whether there is an obstacle around the work machine 100. The detection information includes information indicating whether, when there is an obstacle, the obstacle is present within the range of the work motion of the work machine 100, as well as the distance between the obstacle and the work machine 100.

In addition, the processor 152 is configured or programmed to perform a function of processing the image data generated by the camera 120 and providing the processed image data to the remote controller 200.

Figure 5:
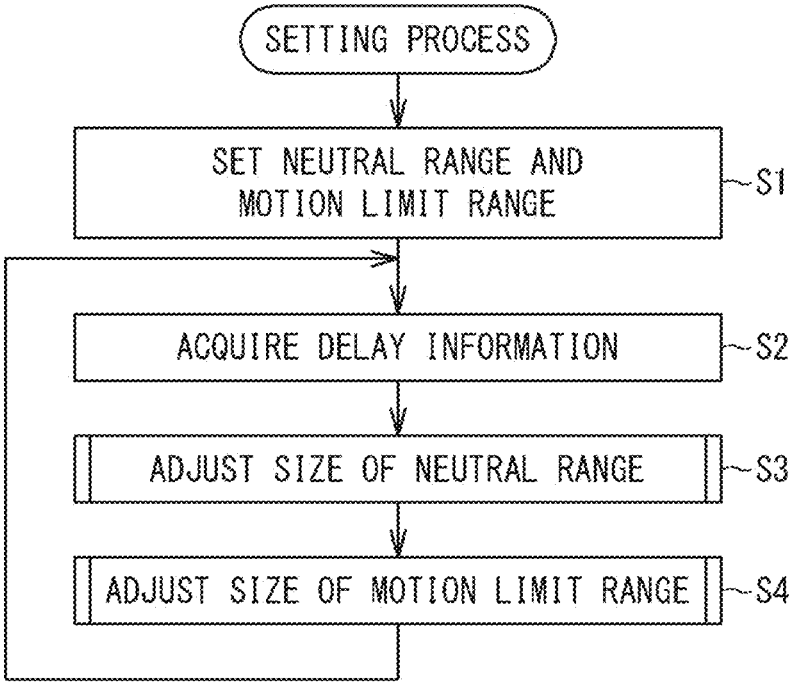
FIG. 5 is a flowchart illustrating an example of a setting process performed by a processor of the remote controller.

FIG. 5 is a flowchart illustrating an example of a setting process performed by the processor 222 of the remote controller 200.

In the following description, a setting process for the operation range of the first operation lever 310 in the X1 direction will be described.

In the setting process, the processor 222 first sets a neutral range and a motion limit range to the movement range of the first operation lever 310 (step S1 in FIG. 5).

The neutral range is a range in which the work motion of the work machine 100 is limited. When the first operation lever 310 is located in the neutral range, the processor 222 stops transmitting the control command. Thus, when the first operation lever 310 is located in the neutral range, the work machine 100 stops the work motion.

Further, the motion limit range is a range in which the work motion of the work machine 100 is limited. When the first operation lever 310 is located in the motion limit range, the processor 222 stops transmitting the control command. Thus, when the first operation lever 310 is located in the motion limit range, the work machine 100 stops the work motion.

The processor 222 transmits the control command in a range except for the neutral range and the motion limit range within the movement range.

Figure 6:
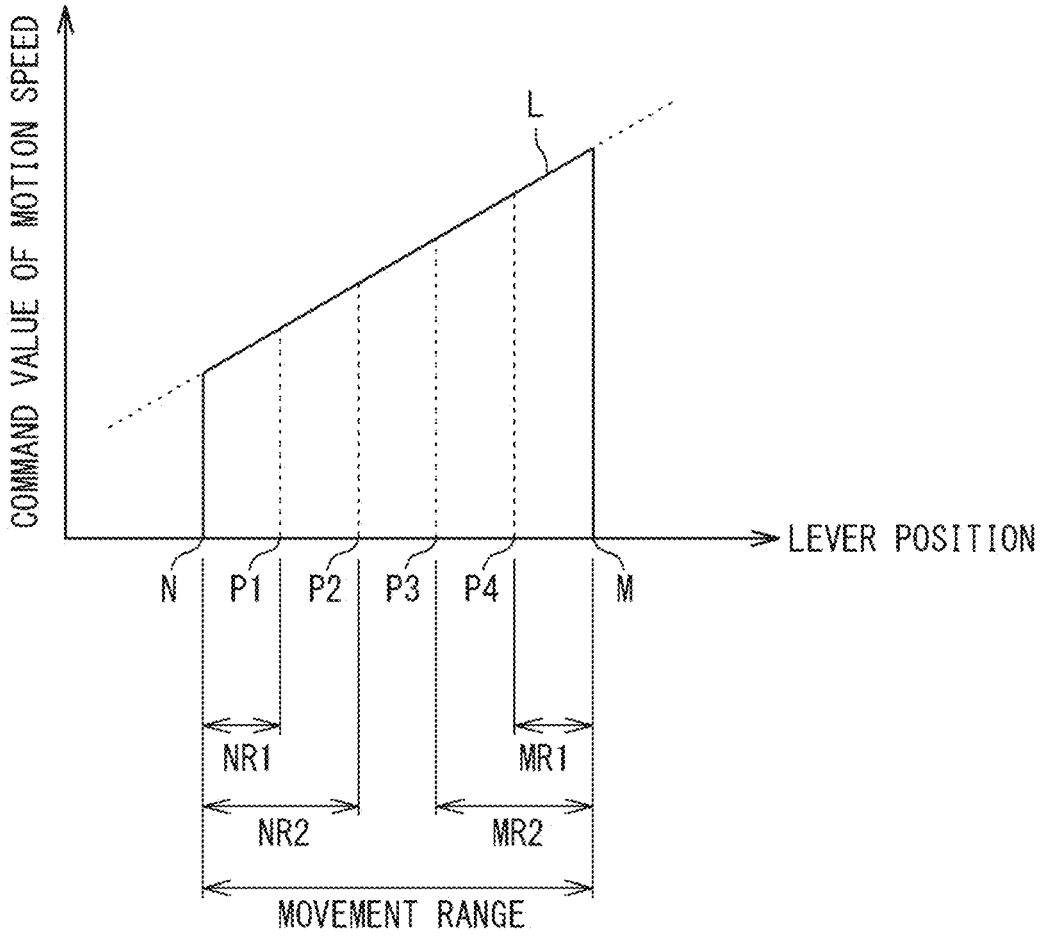
FIG. 6 is a diagram for explaining a neutral range and a motion limit range.

FIG. 6 is a diagram for explaining the neutral range and the motion limit range. FIG. 6 illustrates the movement range of the first operation lever 310 in the X1 direction.

In FIG. 6, the horizontal axis represents the position of the first operation lever 310, and the vertical axis represents the command value for the motion speed. A straight line L indicates the relationship between the position of the first operation lever 310 and the command value for the motion speed.

The first operation lever 310 is movable from a neutral position N to a maximum operation position M. Thus, the range from the neutral position N to the maximum operation position M is the movement range of the first operation lever 310.

The position of the operation lever 310 is a position determined within the movement range between the neutral position N and the maximum operation position M. That is, the position of the operation lever 310 indicates the amount of operation by the operator 400.

The processor 222 selects and sets the neutral range from either a range NR1 or a range NR2. The range NR1 and the range NR2 are set on the neutral position N side within the movement range.

The range NR1 is the range between the neutral position N and a position P1. The range NR1 includes the neutral position N. The position P1 is a position adjacent to the neutral position N.

The range NR2 is the range between the neutral position N and a position P2. The range NR2 includes the neutral position N. The position P2 is a position closer to the maximum operation position M than the position P1.

Thus, the range NR2 has a wider range than the range NR1.

Further, the processor 222 selects and sets the motion limit range from any of a range MR1, a range MR2, and no motion limit range. The range MR1 and the range MR2 are set on the maximum operation position M side within the movement range. When no motion limit range is selected, it is indicated that the motion limit range is not set in the movement range.

The range MR1 is the range between the maximum operation position M and a position P4. The range MR1 includes the maximum operation position M. The position P4 is a position adjacent to the maximum operation position M.

The range MR2 is the range between the maximum operation position M to a position P3. The range MR2 includes the maximum operation position M. The position P3 is a position closer to the neutral position N than the position P4 and is a position between the position P2 and the position P4.

Thus, the range MR2 has a wider range than the range MR1.

In step S1 in FIG. 5, the processor 222 sets the range NR1 as a neutral range to the movement range. Further, the processor 222 selects no motion limit range for the movement range.

Next, the processor 222 proceeds to step S2 and acquires delay information (step S2 in FIG. 5).

The delay information is information indicating a communication delay between the work machine 100 and the remote controller 200. In the present example embodiment, the delay information includes a communication delay time. The communication delay time is a time required for communication between the work machine 100 and the remote controller 200.

The processor 222 acquires a round trip time as a communication delay time (delay information) by, for example, transmitting a packet for delay time measurement to the work machine 100.

Next, the processor 222 proceeds to step S3 and adjusts the size of the neutral range (step S3 in FIG. 5).

Figure 7:
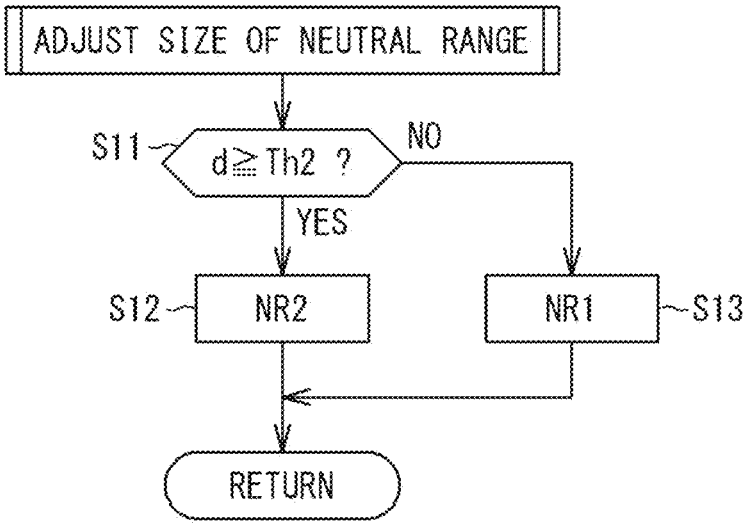
FIG. 7 is a flowchart illustrating an example of a process of adjusting a size of a neutral position.

FIG. 7 is a flowchart illustrating an example of a process of adjusting the size of the neutral position.

The processor 222 determines whether communication delay time d included in the delay information is equal to or greater than a threshold Th2 (step S11 in FIG. 7).

When determining the communication delay time d is not equal to or greater than the threshold Th2 (less than the threshold Th2), the processor 222 sets the range NR1 as the neutral range and terminates the process.

On the other hand, when determining the communication delay time d is equal to or more than the threshold Th2, the processor 222 sets the range NR2 as the neutral range and terminates the process.

In this manner, the processor 222 adjusts the size of the neutral range based on the delay information in step S3 in FIG. 5.

The processor 222, having adjusted the size of the neutral range, proceeds to step S4 in FIG. 5 and adjusts the size of the motion limit range (step S4 in FIG. 5).

Figure 8:
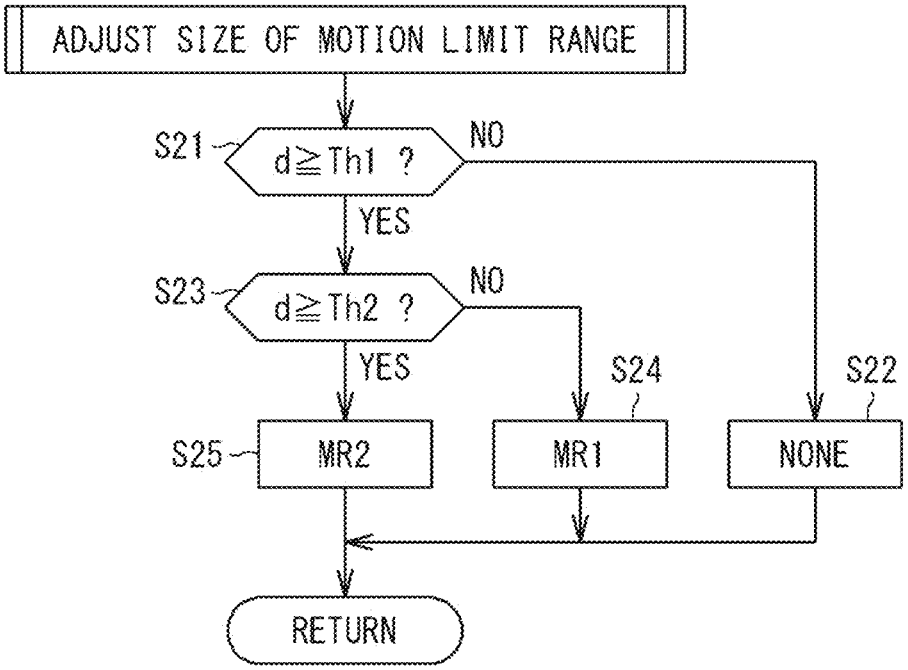
FIG. 8 is a flowchart illustrating an example of a process of adjusting the size of the motion limit range.

FIG. 8 is a flowchart illustrating an example of a process of adjusting the size of the motion limit range.

The processor 222 determines whether the communication delay time d is equal to or greater than a threshold Th1 (step S21 in FIG. 8). Here, the threshold Th1 is a value less than the threshold Th2.

When determining the communication delay time d is not equal to or greater than the threshold Th1 (less than the threshold Th1), the processor 222 does not set the motion limit range (step S22 in FIG. 8) and terminates the process.

When determining that the communication delay time d is equal to or greater than the threshold Th1, the processor 222 determines whether the communication delay time d is equal to or greater than the threshold Th2 (step S23 in FIG. 8).

When determining that the communication delay time d is not equal to or greater than the threshold Th2 (less than the threshold Th2), the processor 222 sets the range MR1 as the motion limit range and terminates the process.

When determining the communication delay time d is equal to or more than the threshold Th2, the processor 222 sets the range MR2 as the motion limit range and terminates the process.

In this manner, the processor 222 adjusts the size of the motion limit range based on the delay information in step S4 in FIG. 5.

The processor 222 repeatedly executes steps S2 to step S4 in FIG. 5.

The threshold Th1 is set to a value that is slightly long as a communication delay and may affect the operation of the operator 400. The threshold Th2 is set to a value that is long as a communication delay and may significantly affect the operation of the operator 400.

When the processor 222 repeatedly executes steps S2 to step S4, the sizes of the neutral range and the motion limit range are adjusted based on the delay information (communication delay time d).

For example, in a case where the communication delay time d is less than the threshold Th1, the processor 222 generates a control command when the first operation lever 310 is located in the range from the position P1 to the maximum operation position M within the movement range in FIG. 6. The control command is generated based on the command value for the motion speed obtained from the relationship indicated by the straight line L.

When the communication delay time d is between the threshold Th1 and the threshold Th2, the processor 222 generates a control command when the first operation lever 310 is located in the range from the position P1 to the position P4 within the movement range in FIG. 6.

In a case where the communication delay time d is greater than the threshold Th2, the processor 222 generates a control command when the first operation lever 310 is located in the range from the position P2 to the position P3 within the movement range in FIG. 6.

Here, when the communication delay between the remote controller 200 and the work machine 100 becomes long, a time difference may occur between the operation input of the operator and the work motion of the work machine corresponding to the operation input. Such a time difference may cause a deterioration in operation accuracy when the operator 400 remotely operates the work machine 100.

In this regard, in the present example embodiment, when the communication delay time d becomes relatively long, the neutral range is extended from the range NR1 to the range NR2.

When the neutral range is adjusted to be extended, the difference between the timing at which the operator 400 starts operating the first operation lever 310 and the timing at which the transmission of the control command to the work machine is started becomes greater than that before the extension of the neutral range. This causes the amount of operation accepted as the control command for the work machine 100 to be smaller than the amount of operation of the first operation lever 310 by the operator 400. Therefore, the amount of motion of the work machine 100 can be reduced compared to the amount of motion of the work machine 100 before the extension of the neutral range.

In the setting process of the present example embodiment, when the communication delay between the remote controller 200 and the work machine 100 becomes relatively long, the neutral range is adjusted to be extended. Accordingly, even in a situation where the communication delay becomes relatively long and the work machine 100 performs a motion with a delay to the operation input of the operator 400, the actual amount of motion of the work machine 100 can be reduced relative to the amount of operation by the operator 400. As a result, it is possible to prevent the position of the work machine 100 from exceeding the target position, and to prevent a deterioration in operation accuracy.

The same applies to the motion limit range, and even in a situation where the communication delay between the remote controller 200 and the work machine 100 has become relatively long and the work machine 100 performs a motion with a delay to the operation input of the operator 400, by providing the motion limit range, the actual amount of motion of the work machine 100 can be reduced relative to the amount of operation by the operator 400. As a result, it is possible to prevent the position of the work machine 100 from exceeding the target position, and to prevent a deterioration in operation accuracy.

It is also possible to make the operator 400 aware of the situation of the long communication delay through the reduced amount of motion of the work machine 100 relative to his or her operation, and to alert the operator 400.

The processor 222 performs the same process not only for the X1 direction of the first operation lever 310 but also for the other directions of the first operation lever 310. The processor 222 also performs the same process for each direction of the second operation lever 320.

However, in the setting process for the operation range in each direction of the first operation lever 310 and the second operation lever 320, a neutral range and a motion limit range of different sizes may be set, even at the same timing.

In the present example embodiment, for the operation inputs in the seven directions other than the X1 direction of the first operation lever 310, as illustrated in FIG. 6, the positions P1, P2, P3, P4 are set within the movement range, and the neutral range and the motion limit range are set based on these positions. As the command value for the motion speed, an appropriate value is set for each work motion.

Figure 9:
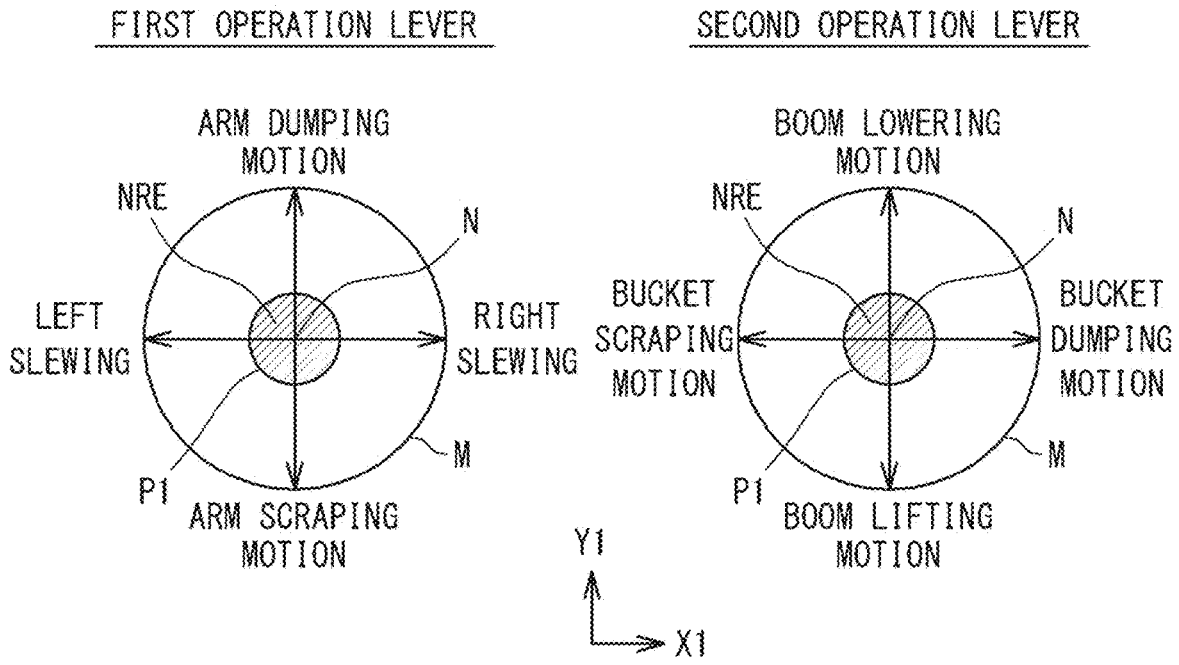
FIG. 9 is a view illustrating a neutral range within a movement range of each of a first operation lever and a second operation lever.

FIG. 9 is a view illustrating a neutral range within the movement range of each of the first operation lever 310 and the second operation lever 320, and illustrates the neutral range when the communication delay time d is less than the threshold Th1.

In FIG. 9, the outermost circle among circles centered at the neutral position N is the maximum operation position M. That is, in FIG. 9, the area of the movement range of each of the operation levers 310, 320 is a range surrounded by the maximum operation position M, which is a circle.

When the communication delay time d is less than the threshold Th1, the neutral range in each direction is set to the range NR1 (the range from the neutral position N to the position P1).

Thus, a neutral range area NRE is a range surrounded by a circle passing through the position P1 in each direction and centered at the neutral position N.

As described above, when the communication delay time d is less than the threshold Th1, the circular neutral range area NRE is set in the central portion of the movement range.

Figure 10A:
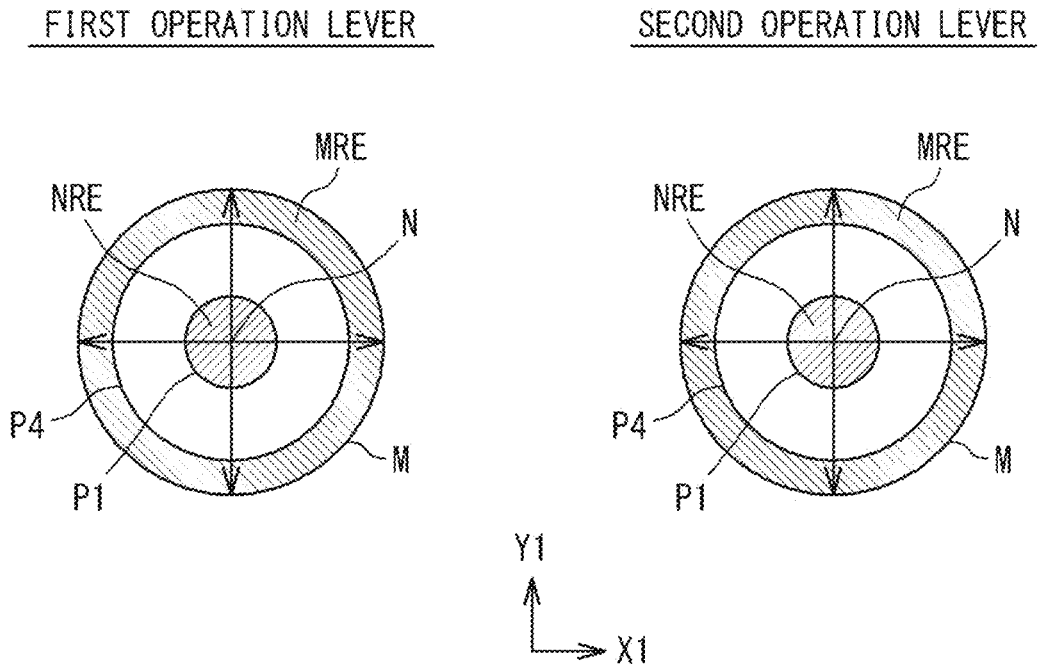
FIG. 10A is a view illustrating an example of the neutral range and the motion limit range within the movement range of each of the first operation lever and the second operation lever.

FIG. 10A is a diagram illustrating an example of the neutral range and the motion limit range within the movement range of each of the first operation lever 310 and the second operation lever 320, and illustrates the neutral range and the motion limit range when the communication delay time d is between the threshold Th1 and the threshold Th2.

When the communication delay time d is between the threshold Th1 and the threshold Th2, the neutral range in each direction is set to the range NR1 (the range from the neutral position N to the position P1). The motion limit range in each direction is set to the range MR1 (the range from the maximum operation position M to the position P4). Thus, a motion limit range area MRE is an annular area surrounded by the maximum operation position M and a circle passing through the position P4 in each direction and centered at the neutral position N.

As described above, when the communication delay time d is between the threshold Th1 and the threshold Th2, the annular motion limit range area MRE is set around a circular neutral range NR.

Figure 10B:
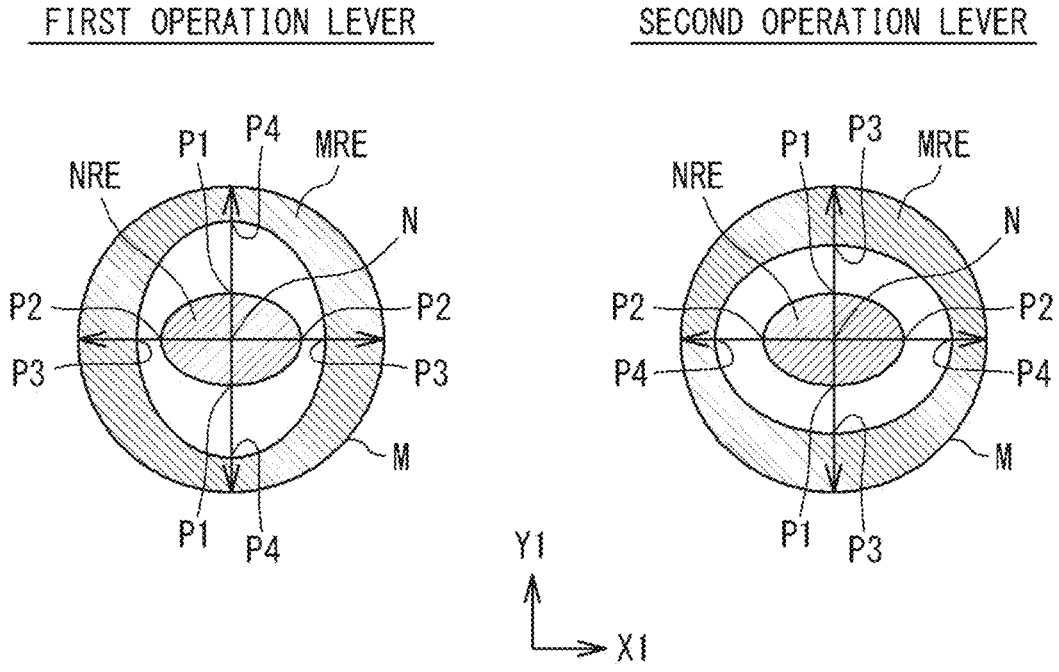
FIG. 10B is a view illustrating another example of the neutral range and the motion limit range within the movement range of each of the first operation lever and the second operation lever.

FIG. 10B is a diagram illustrating an example of the neutral range and the motion limit range within the movement range of each of the first operation lever 310 and the second operation lever 320, and illustrates the neutral range and the motion limit range when the communication delay time d is greater than the threshold Th2.

In this case, in the X1 direction of the first operation lever 310, the neutral range NR is set to the range NR2, and the motion limit range is set to the range MR2. It is assumed that the same setting is performed in the X2 direction of the first operation lever 310.

On the other hand, in the Y1 direction and the Y2 direction of the first operation lever 310, the neutral range NR is set to the range NR1, and the motion limit range is set to the range MR1.

That is, the size of the neutral range in the X1 direction differs from the size of the neutral range in the Y1 direction orthogonal to the X1 direction.

Similarly, the size of the motion limit range in the X1 direction differs from the size of the motion limit range in the Y1 direction orthogonal to the X1 direction.

Here, the greater the work motion of the work machine 100, the greater the impact of the work motion of the work machine 100 on the surroundings.

An operation input for the slewing motion of the machine body 11 is assigned to the X direction of the first operation lever 310. An operation input for the motion of the arm 15 is assigned to the Y direction of the first operation lever 310.

That is, the work motion performed in the X direction of the first operation lever 310 is greater than the work motion performed in the Y direction.

Therefore, in the present example embodiment, the size of the neutral range and the size of the motion limit range in the X1 (X2) direction are set larger than the size of the neutral range and the size of the motion limit range in the Y1 (Y2) direction orthogonal to the X direction.

As a result, the actual amount of motion of the work machine 100 relative to the amount of operation can be further reduced for the slewing motion, which is a greater motion, thus reducing the impact of the motion of the work machine 100 on the surroundings.

In addition, for example, even if the operator 400 accidentally drops the operating device 300, it is possible to prevent a malfunction.

In the X1 direction of the second operation lever 320, the neutral range NR is set to the range NR2, and the motion limit range is set to the range MR1. It is assumed that the same setting is performed in the X2 direction of the second operation lever 320.

On the other hand, in the Y1 direction and the Y2 direction of the second operation lever 320, the neutral range NR is set to the range NR1, and the motion limit range is set to the range MR2.

In this case as well, the size of the neutral range in the X1 direction differs from the size of the neutral range in the Y1 direction orthogonal to the X1 direction.

Similarly, the size of the motion limit range in the X1 direction differs from the size of the motion limit range in the Y1 direction orthogonal to the X1 direction.

In the second operation lever 320 as well, the amount of motion can be further reduced according to the work motion assigned to the second operation lever 320, and the impact of the motion of the work machine 100 on the surroundings can be reduced.

First Modification

Figure 11:
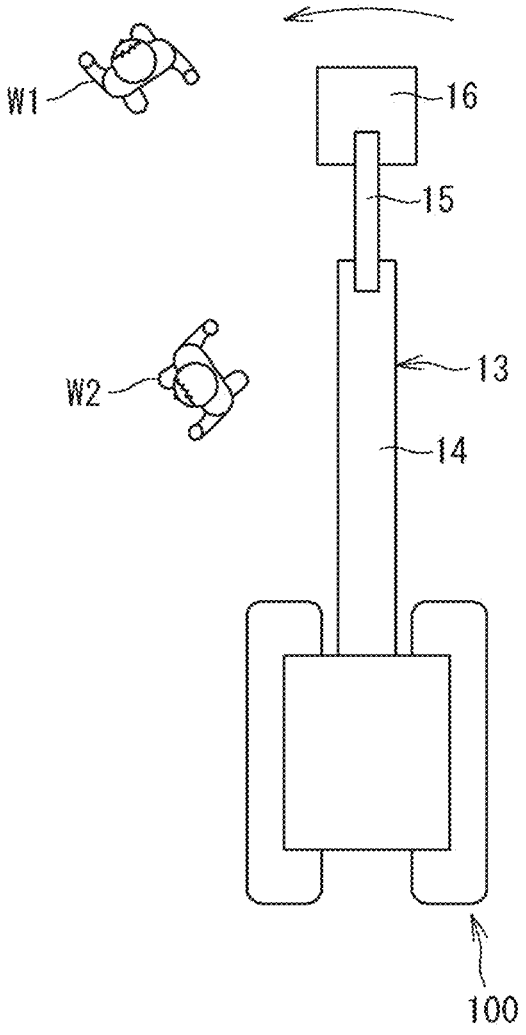
FIG. 11 is a plan view of a work machine 100 remotely operated by a remote controller according to a first modification of an example embodiment of the present disclosure.

FIG. 11 is a plan view of the work machine 100 remotely operated by a remote controller 200 according to a first modification of an example embodiment of the present disclosure.

FIG. 11 illustrates a case where a worker W1 or a worker W2 is located around the work machine 100.

The position of the worker W1 is a position where a collision between the work device 13 and the worker W1 can be avoided when the arm 15 performs a scraping motion toward the boom 14.

When the obstacle sensor 130 detects the presence of the worker W1, (the processor 152 of) the work machine 100 provides the remote controller 200 with detection information including the distance to and the position of the worker W1 (obstacle).

Upon accepting the detection information from the obstacle sensor 130 of the work machine 100, the processor 222 of the remote controller 200 adjusts the motion limit range based on the delay information and the detection information when adjusting the size of the motion limit range in the setting process (step S4 in FIG. 5).

In this case, the processor 222 recognizes the presence of the worker W1 at the position described above using the detection information. Based on this recognition, the processor 222 determines to partially limit the dumping motion of the arm 15 and the left slewing motion of the machine body 11.

Here, when the communication delay time d is less than the threshold Th1, the processor 222, in principle, sets the neutral range area NRE as illustrated in FIG. 9 and does not set the motion limit range area.

Figure 12A:
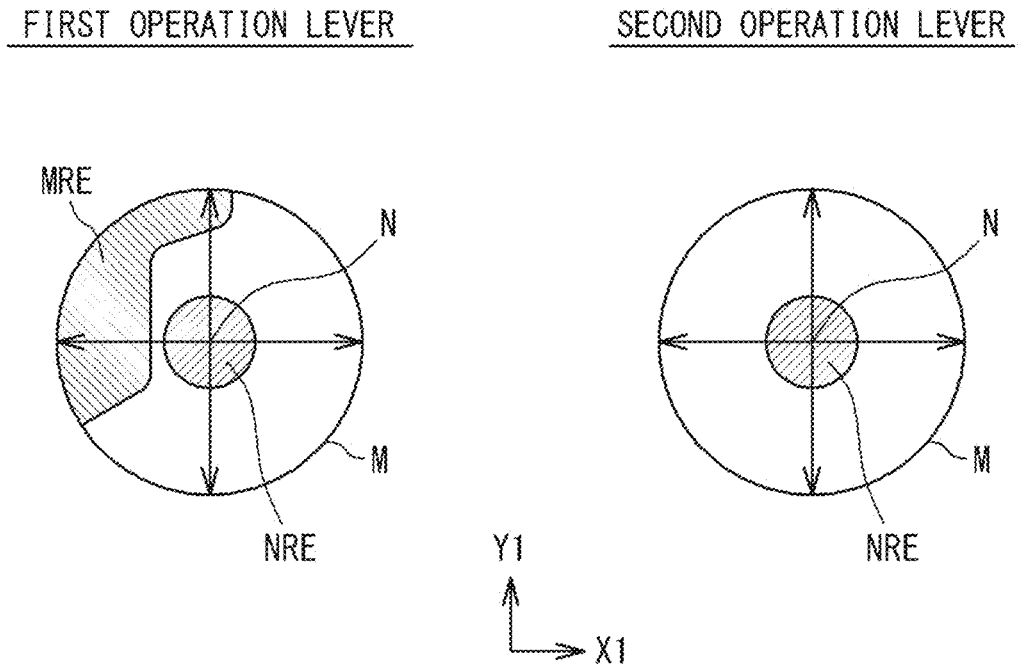
FIG. 12A is a view illustrating an example of a neutral range and a motion limit range within a movement range of each of a first operation lever and a second operation lever in the first modification.

However, the processor 222, having determined to limit the dumping motion of the arm 15 and the left slewing motion of the machine body 11, sets the motion limit range area MRE, extending over a portion of the first operation lever in the Y1 direction and a portion of the first operation lever 310 in the X2 direction, as illustrated in FIG. 12A. This limits an operation input in the direction where the worker W1 (obstacle) is located.

In FIG. 11, the position of the worker W2 is a position where the work device 13 and the worker W2 are on the verge of colliding when the machine body 11 is slewed to the left.

In this case as well, upon accepting the detection information from the obstacle sensor 130 of the work machine 100, the processor 222 of the remote controller 200 adjusts the motion limit range based on the delay information and the detection information when adjusting the size of the motion limit range in the setting process (step S4 in FIG. 5).

In this case, the processor 222 determines to limit the entire left slewing motion of the machine body 11.

Figure 12B:
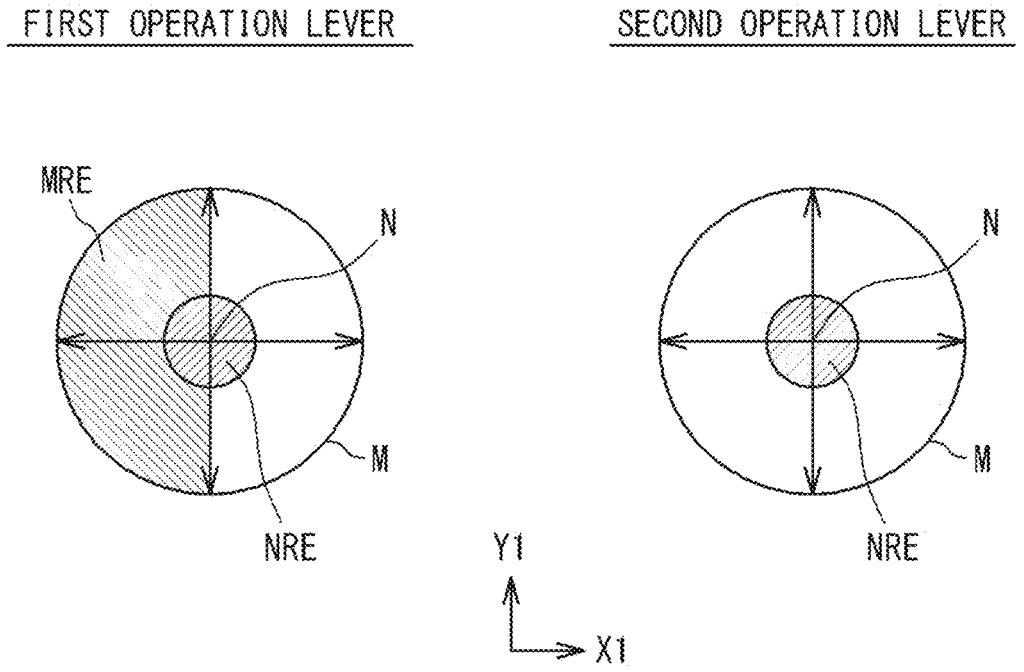
FIG. 12B is a view illustrating another example of the neutral range and the motion limit range within the movement range of each of the first operation lever and the second operation lever in the first modification.

As illustrated in FIG. 12B, the processor 222 sets the motion limit range area MRE for the entire first operation lever 310 in the X2 direction. This prevents acceptance of an operation input for the left slewing motion of the machine body 11.

When the communication delay time d is greater than the threshold Th2, the processor 222, in principle, sets the neutral range area NRE and the motion limit range area MRE as illustrated in FIG. 10B.

Figure 13:
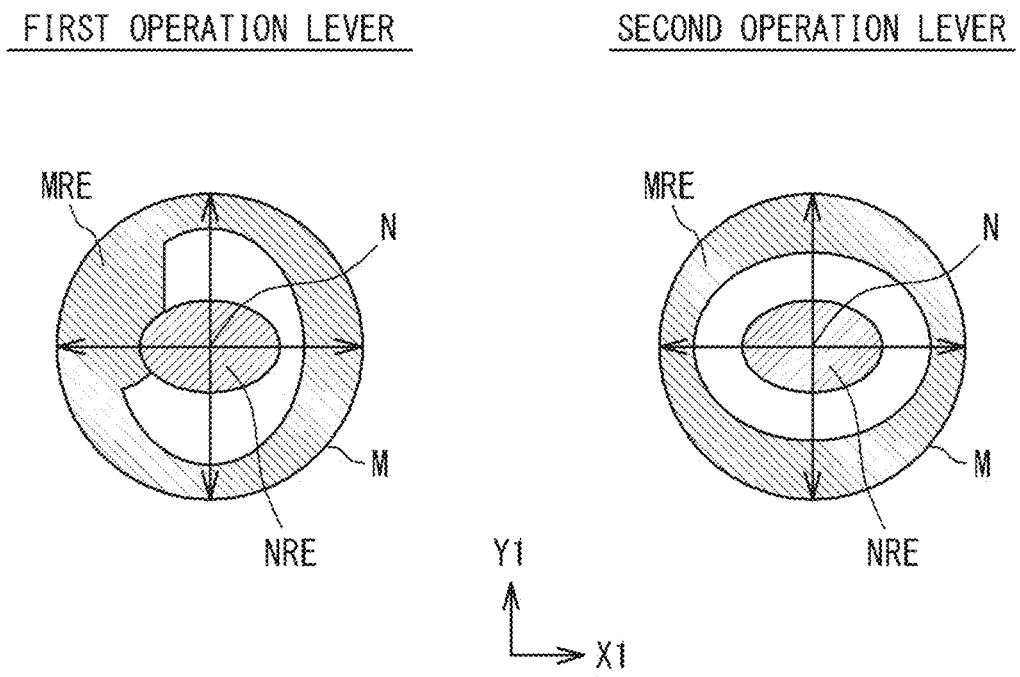
FIG. 13 is a view illustrating still another example of the neutral range and the motion limit range within the movement range of each of the first operation lever and the second operation lever in the first modification.

At this time, the processor 222, having recognized the presence of the worker W1 illustrated in FIG. 11, sets the motion limit range area MRE, extending over a portion of the first operation lever in the Y1 direction and a portion of the first operation lever 310 in the X2 direction, as illustrated in FIG. 13. This limits an operation input in the direction where the worker W1 (obstacle) is located.

As described above, in the present modification, the processor 222 executes the process of accepting an input for the workable range of the work machine 100. The size of the motion limit range MR (motion limit range area MRE) is adjusted based on the communication delay time d and the detection information.

Therefore, when the detection information includes information indicating the presence of an obstacle within the work motion range of the work machine 100, extending the motion limit range area MRE can reduce the actual amount of motion of the work machine 100 relative to the amount of operation by the operator 400, and the work motion can be limited, for example, by stopping the work motion or by keeping the motion speed low.

As a result, it is possible to prevent the work machine 100 from interfering with the obstacle or to make the operator 400 aware of situations where the amount of motion needs to be limited, such as the presence of an obstacle, through the reduced motion of the work machine relative to their operation, and to alert the operator 400.

In addition, when the detection information includes the distance between the work machine 100 and the obstacle, the size of the motion limit range area MRE can be configured to be extended as the distance is shorter.

In this case, the closer the work machine 100 is to the obstacle, the more the actual amount of motion of the work machine 100 relative to the amount of operation by the operator 400 can be limited.

Second Modification

Figure 14:
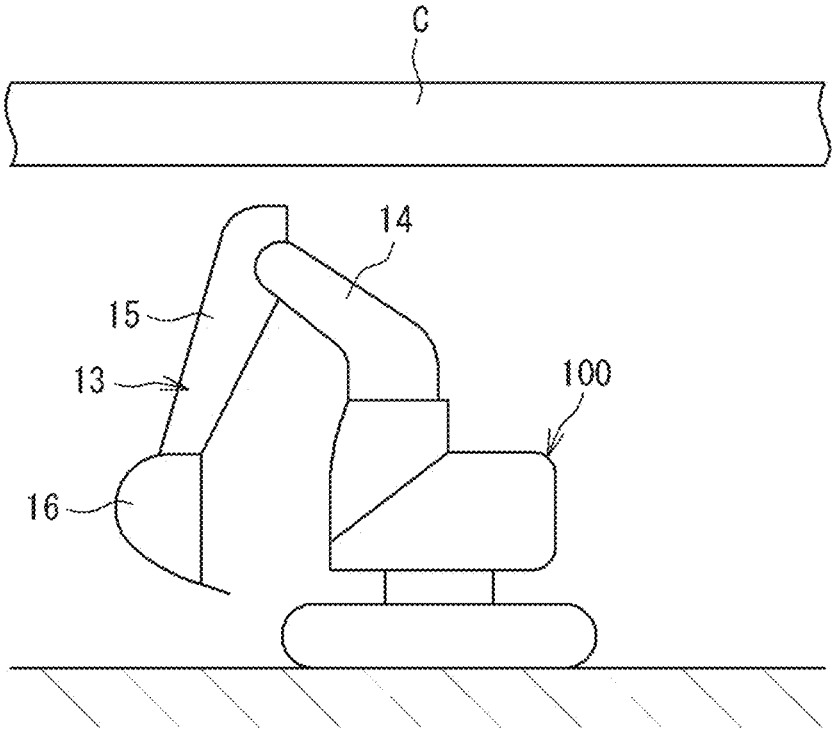
FIG. 14 is a side view of a work machine remotely operated by a remote controller according to a second modification of an example embodiment of the present disclosure.

FIG. 14 is a side view of the work machine 100 remotely operated by a remote controller 200 according to a second modification of an example embodiment of the present disclosure.

FIG. 14 illustrates a case where a ceiling C is located above the work machine 100.

The height of the ceiling C is such a height that the ceiling C and the work device 13 will collide with each other if the boom 14 is lifted too much.

In this case, since the height of the ceiling C is known, the operator 400 can provide the height of the ceiling C to the processor 222 in advance as a workable range.

The processor 222 can accept the workable range (the height of the ceiling C) from the operator 400 and reflect the workable range in the setting process.

That is, when adjusting the size of the motion limit range in the setting process (step S4 in FIG. 5), the processor 222 adjusts the motion limit range based on the delay information and the workable range.

In this case, the processor 222 recognizes the position of the ceiling C based on the workable range.

Further, the processor 222 can determine the position of the work machine 100 and the position of the working device 13 based on the position information and the motion information of the work machine 100.

Therefore, the processor 222 can obtain the interval between the ceiling C and the boom 14 based on the workable range, the position information, and the motion information.

When the distance between the ceiling C and the work device 13 becomes equal to or less than a predetermined value during the work motion, the processor 222 determines to limit the lifting motion of the boom 14.

Here, when the communication delay time d is less than the threshold Th1, the processor 222, in principle, sets the neutral range area NRE as illustrated in FIG. 9 and does not set the motion limit range area.

Figure 15:
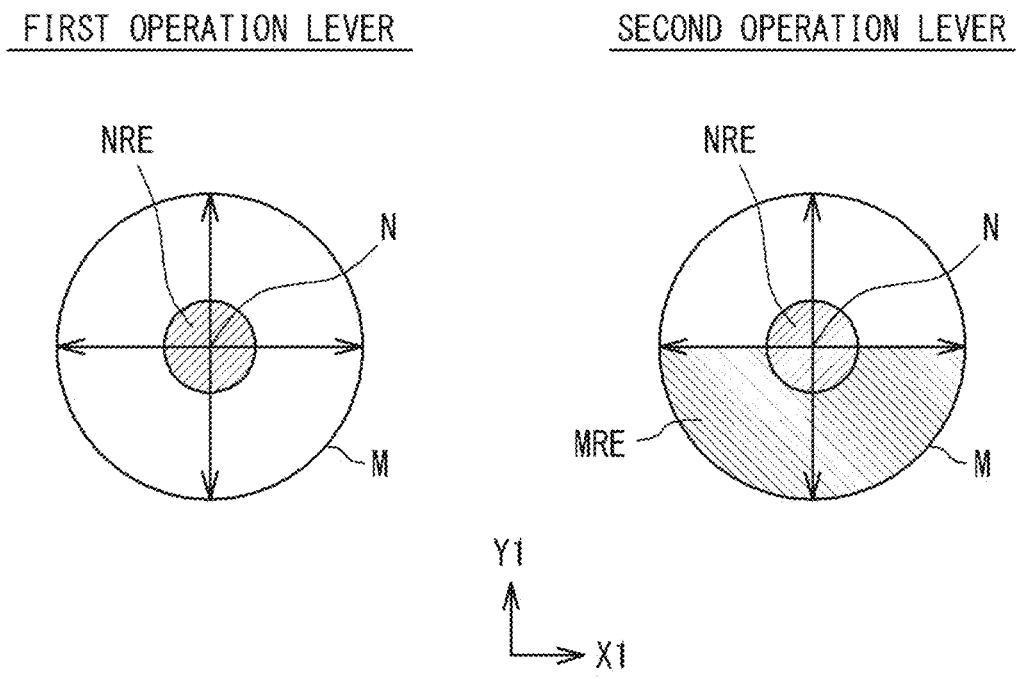
FIG. 15 is a view illustrating an example of a neutral range and a motion limit range within a movement range of each of a first operation lever and a second operation lever in the second modification.

However, as illustrated in FIG. 15, the processor 222, having determined to limit the lifting motion of the boom 14, sets the motion limit range area MRE for the entire second operation lever 320 in the Y2 direction. This prevents acceptance of an operation input in the direction of raising the boom 14.

Figure 16:
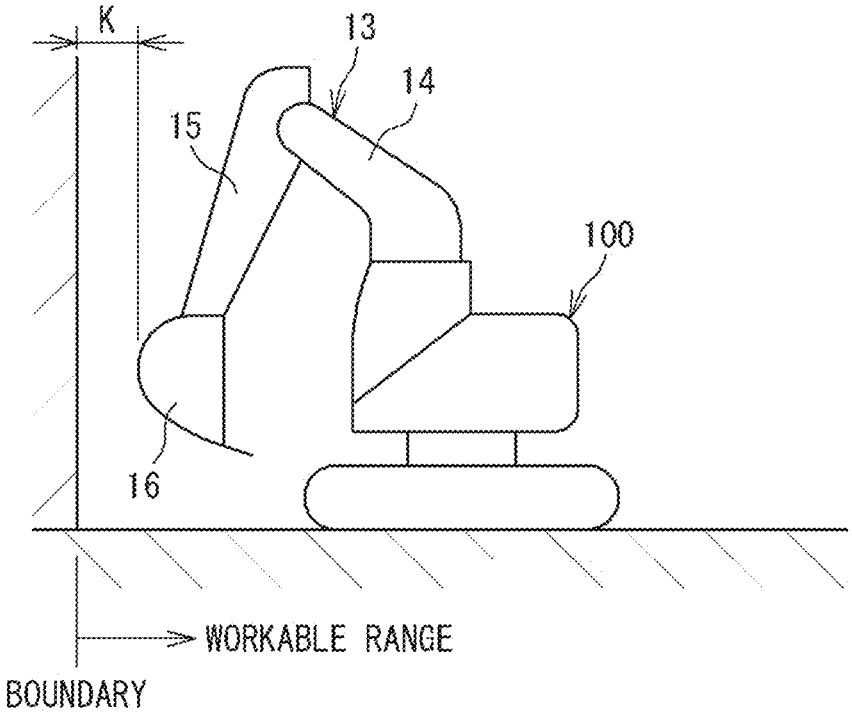
FIG. 16 is a side view of the work machine remotely operated by the remote controller according to the second modification.

FIG. 16 is another example of the side view of the work machine 100 remotely operated by the remote controller 200 according to the second modification.

FIG. 16 illustrates a case where the horizontal boundary of the workable range is located in front of the work machine 100. More specifically, the position of the work machine 100 is a position where an interval K is between the boundary and the work tool 16 of the work machine 100.

FIG. 16 illustrates state where the work tool 16 crosses the boundary if the arm 15 is caused to perform an excessive dumping motion.

The workable range is provided to the processor 222. Thus, the processor 222 recognizes the position of the boundary of the workable range.

Further, the processor 222 can determine the position of the work machine 100 and the position of the working device 13 based on the position information and the motion information of the work machine 100.

Therefore, the processor 222 can obtain the interval K based on the workable range, the position information, and the motion information.

When the interval K becomes equal to or less than the first threshold during the work motion, the processor 222 determines to limit the lifting motion of the boom 14.

Figure 17A:
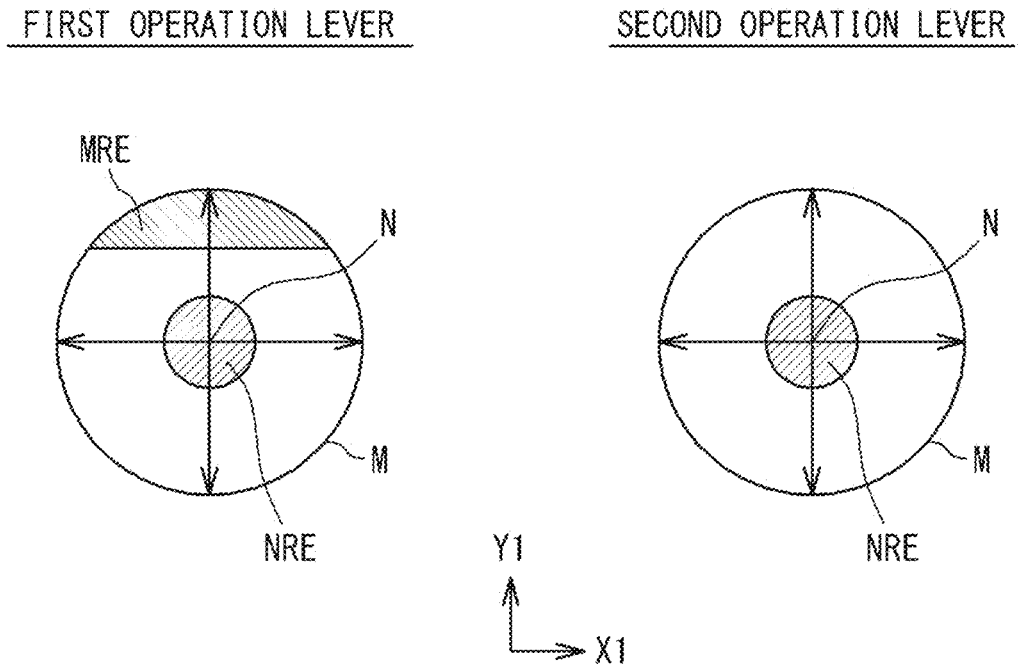
FIG. 17A is a view illustrating another example of the neutral range and the motion limit range within the movement range of each of the first operation lever and the second operation lever in the second modification.

As illustrated in FIG. 17A, the processor 222 sets the motion limit range area MRE for a portion of the first operation lever 310 in the Y1 direction. This limits an operation input in the direction where the arm 15 is caused to perform a dumping motion.

Figure 17B:
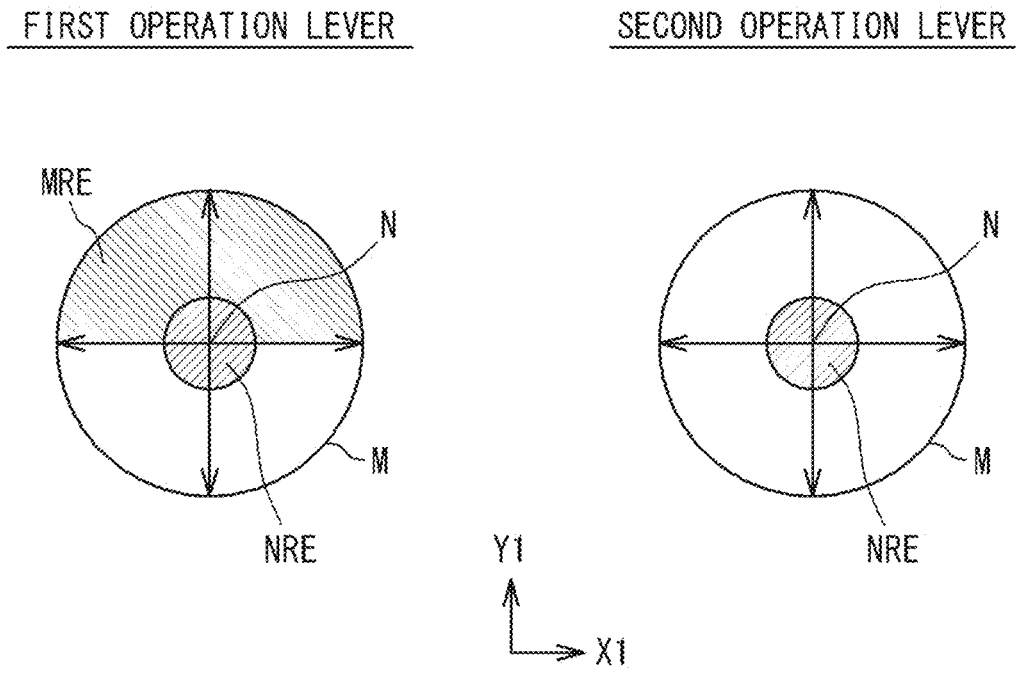
FIG. 17B is a view illustrating still another example of the neutral range and the motion limit range within the movement range of each of the first operation lever and the second operation lever in the second modification.

Moreover, when the interval K becomes equal to or less than the second threshold, the processor 222 sets the motion limit range area MRE for the entire first operation lever 310 in the Y1 direction as illustrated in FIG. 17B. This prevents acceptance of an operation input in the direction where the arm 15 is caused to perform a dumping motion.

The second threshold is a value less than the first threshold and is a value indicating that the work tool 16 is immediately before crossing the boundary.

When determining that the work tool 16 is immediately before crossing the boundary, the processor 222 does not accept an operation input in the direction where the arm 15 is caused to perform a dumping motion. Thus, it is possible to prevent the work tool 16 from crossing the boundary.

As described above, in the present modification, the processor 222 further executes the process of accepting an input for the workable range of the work machine 100. The size of the motion limit range MR (motion limit range area MRE) is adjusted based on the delay information and the workable range.

More specifically, the size of the motion limit range area MRE is configured to be extended as the interval K is shorter.

As a result, the closer the work machine 100 is to the boundary of the workable range, the more the actual amount of motion of the work machine 100 relative to the amount of operation by the operator 400 can be limited, preventing operations that would cause the work machine 100 to exceed the workable range.

In the present modification, the case where the workable range is provided from the operator 400 has been exemplified. However, the processor 152 of the work machine 100 or the processor 222 of the remote controller 200 may specify the situation around the work machine 100 using the image data of the camera 120, and the processor 152 or the processor 222 may set the workable range based on the specified situation.

Note that the example embodiments disclosed herein are to be considered as illustrative and non-restrictive in every respect.

For example, the operator may inch the work machine by momentarily applying an operation input to the operation lever. In such a case where a very short-time operation input is performed, it is difficult to accurately adjust the amount of operation.

Therefore, the processor 222 may be configured or programmed to execute a process of measuring the time until each of the operation levers 310, 320 move from the neutral position N and return to the neutral position N, and the processor 222 may be configured or programmed to further adjust the size of the neutral range NR based on the delay information and the time.

In this case, the time taken for each of the operation levers 310, 320 to move from the neutral position N and return to the neutral position N can be used to determine whether the operation input is an input that is performed during an attempt to inch the work machine 100.

Figure 18:
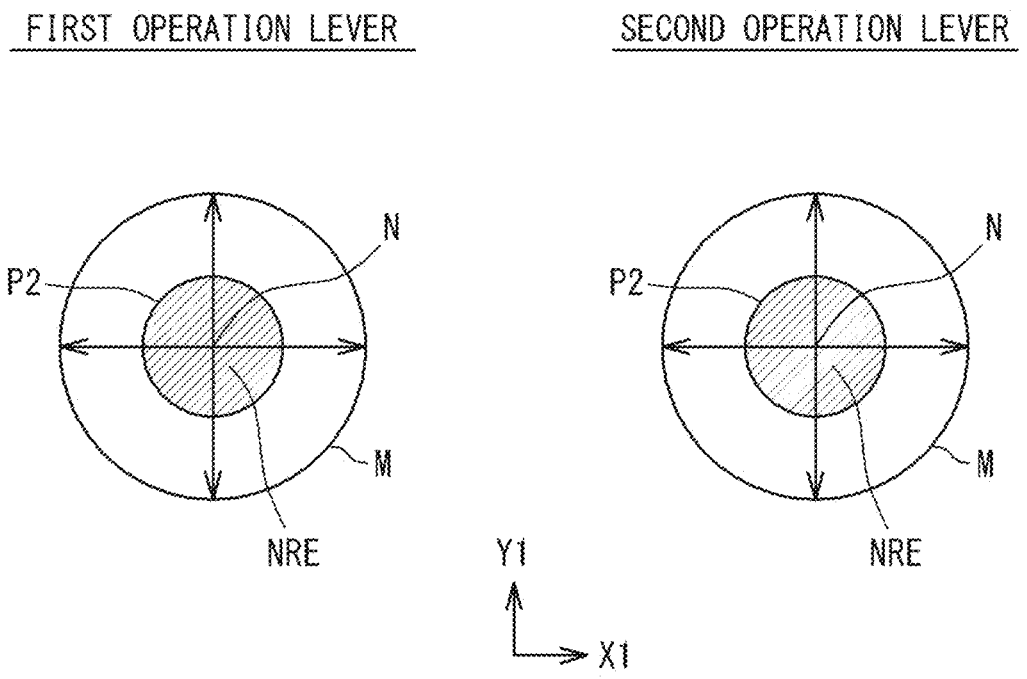
FIG. 18 is a diagram illustrating an example of the neutral range within the movement range of each of the first operation lever and the second operation lever when an operation input is an input that is performed during an attempt to inch the work machine.

Therefore, when the time is a value that allows the determination that the operation input is an input that is performed during an attempt to inch the work machine 100, as illustrated in FIG. 18, the neutral range NR in each direction of the operation levers 310, 320 can be adjusted from the neutral position N to the position P2, and the processor 222 can be adjusted to extend the size of the neutral range NRE.

As a result, even when a very short-time operation input is provided, it is possible to reduce the actual amount of motion of the work machine 100 relative to the amount of operation by the operator 400.

Further, for example, in the above example embodiments, the case where the delay information includes the communication delay time d has been exemplified. However, in addition to the communication delay time d, the delay information may include the difference between the maximum and minimum values obtained by acquiring the communication delay time d over a certain period. When the delay information includes this difference, the processor 222 performs the setting process using the difference.

When the communication delay time d is stable to some extent, the processor 222 does not increase the neutral range NR or the motion limit range MR set for each direction of the levers 310, 320. When the communication delay time d is unstable beyond a certain level, the processor sets the neutral range NR and the motion limit range MR, set in each direction of the levers 310, 320, to be extended.

When the communication delay time d is stable to some extent, the operator 400 can perform an operation input corresponding to the stable communication delay time d and can perform an operation with relatively high accuracy.

However, when the communication delay time d is unstable beyond a certain level, the operator 400 cannot perform an operation input corresponding to the communication delay time d, leading to a deterioration in operation accuracy.

On the other hand, when the processor 222 performs the setting process using the difference described above, even if the communication delay time d becomes unstable, it is possible to prevent a deterioration in operation accuracy.

In the above example embodiments, the case has been exemplified where the size of the neutral range NR is selected from two pattern, range NR1 and range NR2, and the size of the motion limit range MR is selected from two patterns, range MR1 and range MR2.

However, the size of the neutral range NR and the size of the motion limit range MR may be adjusted to be continuous values according to a change in the communication delay time d.

In the above example embodiments, the case has been exemplified where the transmission of the control command is stopped and the work machine 100 stops the work motion when each of the levers 310, 320 is positioned in the neutral range (neutral range area NRE) and the motion limit range (motion limit range area MRE).

However, when each of the levers 310, 320 is located in the motion limit range (motion limit range area MRE), the processor 222 may be configured to provide the work machine 100 with a control command to gradually decelerate the motion speed of the work machine 100, or may be configured to provide the work machine 100 with a control command to maintain a constant motion speed of the work machine 100 or a control command to stop the work motion of the work machine 100.

When each of the levers 310, 320 is positioned in the neutral range (neutral range area NRE), the processor 222 may be configured or programmed to provide the work machine 100 with a control command to stop the work motion of the work machine 100.

In the above example embodiments, the case where the work machine 100 is a backhoe has been exemplified, but the work machine 100 may be a hydraulic excavator other than a backhoe.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A remote operation system for a work machine that performs a work motion, the remote operation system comprising:

an operation lever that is movable in a movement range from a neutral position to a maximum operation position by an operation input of an operator; and a remote controller configured or programmed to generate, based on a position of the operation lever, a control command to perform the work motion and wirelessly transmit the control command to the work machine; wherein the movement range includes a control-permitted range in which the control command is transmitted wirelessly and a neutral range;

the remote controller includes a processor configured or programmed to execute a setting process to set the neutral range on a side of the neutral position within the movement range to limit the work motion of the work machine; and the setting process includes:

acquiring delay information indicating a communication delay with the work machine; and adjusting a size of the neutral range based on the delay information while maintaining a state in which the movement range includes both the control-permitted range and the neutral range.

2. The remote operation system according to claim 1, wherein the delay information includes a communication delay time; and the neutral range is extended as the communication delay time increases.

3. The remote operation system according to claim 1, wherein the delay information includes a communication delay time; and the adjusting the size of the neutral range includes:

comparing the communication delay time with a predetermined threshold; and selecting, based on a result of the comparing, the size of the neutral range from a first size and a second size larger than the first size.

4. The remote operation system according to claim 1, wherein the work motion includes a first motion and a second motion different from the first motion;

the operation lever is movable in a first direction from the neutral position and is movable in a second direction orthogonal to the first direction;

the control command includes a first control command to cause the work machine to perform the first motion and a second control command to cause the work machine to perform the second motion;

the first control command is a command generated based on a position of the operation lever in a first movement range along the first direction from the neutral position;

the second control command is a command generated based on the position of the operation lever in a second movement range along the second direction from the neutral position;

the neutral range includes a first neutral range set to the first movement range and a second neutral range set to the second movement range; and a size of the first neutral range and a size of the second neutral range are adjusted to be different from each other.

5. The remote operation system according to claim 1, wherein when the position of the operation lever is in the neutral range, the processor is configured or programmed to execute at least one of stopping transmission of the control command by the remote controller or including a command to stop the work motion in the control command.

6. The remote operation system according to claim 1, wherein the setting process further includes:

setting a motion limit range to limit the work motion of the work machine on a side of the maximum operation position within the movement range; and adjusting a size of the motion limit range based on the delay information.

7. The remote operation system according to claim 6, wherein the work motion includes a first motion and a second motion different from the first motion;

the operation lever is movable in a first direction from the neutral position and is movable in a second direction orthogonal to the first direction;

the control command includes a first control command to cause the work machine to perform the first motion and a second control command to cause the work machine to perform the second motion;

the first control command is a command generated based on a position of the operation lever in a first movement range along the first direction from the neutral position;

the second control command is a command generated based on the position of the operation lever in a second movement range along the second direction from the neutral position;

the motion limit range includes a first motion limit range set in the first movement range and a second motion limit range set in the second movement range; and a size of the first motion limit range and a size of the second motion limit range are adjusted to be different from each other.

8. The remote operation system according to claim 6, wherein the processor is configured or programmed to execute accepting detection information from an obstacle detector included in the work machine; and the size of the motion limit range is adjusted based on the delay information and the detection information.

9. The remote operation system according to claim 8, wherein the detection information includes a distance between the work machine and an obstacle; and the size of the motion limit range is extended as the distance is shorter.

10. The remote operation system according to claim 8, wherein the obstacle detector includes at least one of an ultrasonic sonar sensor, a light detection and ranging (LIDAR) sensor, a millimeter wave sensor, or an image analyzer including an imager.

11. The remote operation system according to claim 6, wherein the processor is configured or programmed to accept an input of a workable range of the work machine; and the size of the motion limit range is adjusted based on the delay information and the workable range.

12. The remote operation system according to claim 6, wherein when the position of the operation lever is located in the motion limit range, the processor is configured or programmed to execute at least one of stopping transmission of the control command by the remote controller, including a command to stop the work motion in the control command, or including a command to limit a motion speed of the work motion in the control command.

13. The remote operation system according to claim 1, wherein the processor is configured or programmed to execute measuring a time until the operation lever moves from the neutral position and returns to the neutral position; and the size of the neutral range is adjusted based on the delay information and the time.

14. The remote operation system according to claim 1, wherein the work machine further includes a traveling device, a machine body slewably mounted on the traveling device, a boom that is swingable about an axis provided on the machine body and extending laterally, an arm swingably provided at a distal end of the boom, and a work tool swingably provided at a distal end portion of the arm; and the work motion includes at least one of slewing of the machine body, swinging of the boom, swinging of the arm, or swinging of the work tool.

15. A remote controller to generate a control command to cause a work machine to perform a work motion based on a position of an operation lever movable in a movement range from a neutral position to a maximum operation position by an operation input of an operator, and wirelessly transmit the control command to the work machine, the remote controller comprising:

a processor configured or programmed to execute a setting process to set a neutral range on a side of the neutral position within the movement range to limit the work motion of the work machine; wherein the movement range includes a control-permitted range in which the control command is transmitted wirelessly and the neutral range;

the setting process includes:

acquiring delay information indicating a communication delay with the work machine; and adjusting a size of the neutral range based on the delay information while maintaining a state in which the movement range includes both the control-permitted range and the neutral range.

16. A method performed in a remote controller to generate a control command to cause a work machine to perform a work motion based on a position of an operation lever movable in a movement range from a neutral position to a maximum operation position by an operation input of an operator, and wirelessly transmit the control command to the work machine, the movement range including a control-permitted range in which the control command is transmitted wirelessly and a neutral range, the method being a method to set the neutral range on a side of the neutral position within the movement range to limit the work motion of the work machine, the method comprising:

acquiring delay information indicating a communication delay between the remote controller and the work machine; and adjusting a size of the neutral range based on the delay information while maintaining a state in which the movement range includes both the control-permitted range and the neutral range.

* * * * *